US006824243B2

(12) United States Patent
Yamaguchi et al.

(10) Patent No.: US 6,824,243 B2
(45) Date of Patent: Nov. 30, 2004

(54) LIQUID JET PRINT HEAD AND LIQUID JET PRINTING APPARATUS

(75) Inventors: Yukuo Yamaguchi, Tokyo (JP); Yutaka Koizumi, Kanagawa (JP); Mikiya Umeyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 10/366,477

(22) Filed: Feb. 14, 2003

(65) Prior Publication Data

US 2003/0227516 A1 Dec. 11, 2003

(30) Foreign Application Priority Data

Feb. 15, 2002 (JP) ..... 2002-039247

(51) Int. Cl.[7] ..... B41J 2/145; B41J 2/15; B41J 2/045

(52) U.S. Cl. ..... 347/40; 347/71

(58) Field of Search ..... 347/40, 67, 71, 347/14

(56) References Cited

U.S. PATENT DOCUMENTS 4,716,421 A * 12/1987 Ozawa et al. ..... 347/14
5,826,333 A 10/1998 Iketani et al.
6,435,663 B2 8/2002 Yamaguchi et al.
6,554,394 B1 4/2003 Yamaguchi et al.
2002/0033857 A1 3/2002 Ohashi et al.

FOREIGN PATENT DOCUMENTS

JP 7-179004 A 7/1995
JP 2002-254610 A 9/2002

OTHER PUBLICATIONS

U.S. patent application Ser. No. 10/356,509, Yamaguchi et al., filed Feb. 3, 2003, pending.
U.S. patent application Ser. No. 10/359,055, Yamaguchi et al., filed Feb. 6, 2003, pending.
U.S. patent application Ser. No. 10/361,615, Yamaguchi et al., filed Feb. 11, 2003, pending.
U.S. patent application Ser. No. 10/361,621, Yamaguchi et al., filed Feb. 11, 2003, allowed.

* cited by examiner

*Primary Examiner*—Thinh Nguyen
(74) *Attorney, Agent, or Firm*—Fitzpatrick, Cella, Harper & Scinto

(57) ABSTRACT

A liquid jet print head can be installed in an ink jet printer and includes a printing unit, a printing device substrate and a supporting substrate. Projections of the supporting substrate are used as a reference for positioning when the printing device substrate is attached to the supporting substrate and when the print head is installed in a carriage of the printer. Further, all reference portions used for positioning in the three-dimensional directions when installing the print head in the carriage are gathered in the printing unit.

18 Claims, 23 Drawing Sheets

LIQUID JET PRINT HEAD AND LIQUID JET PRINTING APPARATUS

This application claims priority from Japanese Patent Application No. 2002-039247 filed Feb. 15, 2002, which is incorporated hereinto by reference.

BACKGROUND OF THE INVENTION

1. Field of the Invention

The invention relates to a liquid jet print head and a liquid jet printing apparatus with the same.

2. Description of the Related Art

Liquid jet printing apparatuses with liquid jet print heads are well known. In such a liquid jet printing apparatus, print liquid (ink) is supplied to the liquid jet print head having printing devices such as electrothermal converting elements and piezoelectric elements, and electric pulse signals corresponding to image data are sent to the printing devices. Then, the liquid jet print head ejects print liquid to print desired images on a print medium. As has been described, so called non-impact type liquid jet printing apparatuses can print images on various print media at high speed with low noise. Thus, they are widely adopted as printers, word processors, facsimile, copiers and mailing machines.

FIGS. 20 and 21 show a conventional print head for the liquid jet printing apparatus. The liquid jet print head 100 shown in these drawings has a plurality of electrothermal converting elements (not shown) serving as printing devices. The print head prints images on a print medium by ejecting ink drops from micro nozzles corresponding to each of electrothermal converting elements. Electrothermal converting elements (heaters) for generating heat are arranged on a printing device substrate 101. Also, and a plurality of nozzles 101*a* corresponding to the electrothermal converting elements are arranged on the printing device substrate 101. As shown in FIG. 21, the printing device substrate 101 is bonded to a supporting substrate 102 made of aluminum, ceramics and the like.

On the supporting substrate 102, wiring sheets 103 such as TAB and FPC are bonded so as to supply electric signals to the printing device substrates 101. Each printing device substrate 101 is electrically connected with the wiring sheet 103 by wire bonding or lead bonding. The wiring sheets 103 are connected to a contact substrate 105 such as PWB, TAB and FPC having a plurality of contact pads 104 for electric connection with the liquid jet printing apparatus (not shown). The printing device substrates 101 and contact substrate 105 are connected with a flow path forming member 106 having flow paths 106*a* for print liquid.

A liquid jet print head shown in FIGS. 22 and 23 is also well known The liquid jet print head 200 of these drawings includes a printing unit 201 (FIG. 22) for producing ink drops and a print liquid storage unit 220 (FIG. 23) for supplying print liquid to the printing unit 201. The printing unit 201 includes a printing device substrate 203 where a plurality of printing devices (electrothermal converting elements) 202 that generate energy for ejecting ink drops are arranged. The printing device substrate 203 is bonded to a supporting substrate 204 made of aluminum, ceramics and the like.

Further, a wiring substrate 205 that provides an electric connection with the liquid jet printing apparatus is mounted on the supporting substrate 204 in addition to the printing device substrate 203. The printing device substrate 203 and the wiring substrate 205 are electrically connected with each other by wire bonding or lead bonding. On the printing device substrate 203, shift registers for driving and wiring patterns are formed in addition to the printing devices 202, and they are all formed together with the printing devices 202 on the printing device substrate 203 by silicon device techniques. Contact pads (not shown) are formed on the wiring substrate 205 for electric coupling with the liquid jet printing apparatus.

On the top surface of the printing device substrate 203, a ceiling plate 207 having concave portions is bonded by a pressing means such as a plate spring 206 or with an adhesive. As a result, a liquid chamber 208 and liquid flow paths 209 are formed between the printing device substrate 203 and the ceiling plate 207. An orifice plate 210 is aligned and bonded to the end faces of the printing device substrate 203 and the ceiling plate 207. As shown in FIG. 22, the orifice plate 210 has a number of micro nozzles 210*a* for ejecting ink drops in positions corresponding to the each of printing devices 202 on the printing device substrate 203.

A flow path forming member 212 has a flow path for print liquid and is fixed to the supporting substrate 204. The flow path of the member 212 communicates with an inlet 207*a* formed on the top of the ceiling plate 207. Through the inlet, print liquid is supplied to the liquid chamber 208 formed between the printing device substrate 203 and the ceiling plate 207. The flow path forming member 212 has a porous member 214 faced with the contact area with the ceiling plate 207, and the porous member 214 traps impurities contained in print liquid.

On the other hand, as shown in FIG. 23, the print liquid storage unit 220 includes a frame 221 having a liquid chamber (not shown) for storing print liquid therein. The frame 221 serves as a casing that holds the printing unit 201. The printing unit 201 is fixed to the frame 221 with screws 222 or an adhesive. Their contact portion is sealed with a predetermined sealing agent to be airtight. In the liquid jet print head 200, the print liquid stored in the liquid chamber of the frame 221 is sent to the printing device substrate 203 via the flow path forming member 212 and the ceiling plate 207.

As seen from FIGS. 20 and 21, the liquid jet print head 100 has a structure where a plurality of printing device substrates 101 are bonded to a single supporting substrate 102. On the other hand, as seen from FIGS. 22 and 23, the liquid jet print head 200 has a structure where a single-piece printing device substrate 203 is bonded to the supporting substrate 204. That is, some liquid jet print heads have a structure where a single-piece printing device substrate is bonded to the supporting substrate, and others have a structure where a plurality of printing device substrates are bonded to the supporting substrate. Some of the liquid jet printing apparatuses using the liquid jet print head having only a single-piece printing device substrate have a single liquid jet print head, and others have more than one liquid jet print head.

When the electrothermal converting element receives an electric pulse signal serving as a print signal, the electrothermal converting element provides thermal energy with print liquid. Then, the liquid jet print head utilizes the pressure of bubbles formed by film boiling in print liquid caused by the thermal energy so as to eject ink drops. Some of the liquid jet print heads using electrothermal converting elements eject print liquid in the direction parallel to the substrate where the electrothermal converting elements are arranged (so called, edge shooters, see FIG. 22), and others eject print liquid in the direction perpendicular to the substrate where the electrothermal converting elements are arranged (so called, side shooters).

If a printing device substrate in such a liquid jet print head is excessively heated during operation, there may be problems to the electric pulse signals and to the bubbling state of print liquid. Thus, some heat-dissipating mechanisms are usually provided with the liquid jet print head. For example, in the edge-shooter type liquid jet print head, the supporting substrate disposed on the backside of the silicon printing device substrate is made of aluminum, aluminum alloys or ceramics so that it serves as a heat-dissipating member.

On the other hand, in the side-shooter type liquid jet print head, such a simple method is known that dissipates heat by using print liquid itself ejected from the print liquid storage unit via the back side of the printing device substrate. In side-shooter type liquid jet print heads where high density printing devices may produce much heat, the supporting substrate is formed so as to serve as a heat-dissipating member having a large contact area, and the printing device substrate is fixed to this supporting substrate.

In such liquid jet print heads where nozzles (ink nozzles) are densely arranged and that eject print liquid using a pressure change produced by thermal energy, there will be a phenomenon (called the cross-talk) where the ejection of ink drops becomes unstable because of a pressure wave and heat diffusion from neighboring ink nozzles. To prevent the cross-talk by prohibiting simultaneous ink ejection from neighboring nozzles, the ink nozzles are divided into two or more groups, and the electric pulse signals are controlled so that the each of nozzle groups eject print liquid one after another. For high speed printing, the liquid jet print head must be driven with a high frequency. In such a case, the ink nozzles may be arranged with some displacements corresponding to delay time in accordance with ejection sequence, so as to control ink ejection from each nozzle group and prevent unfavorable dot patterns.

When the amount of tilting of the ink nozzles are different between nozzle groups, the quality of printed images degrades if the print head is tilted too much with respect to the carriage, or if the printing device substrate is positioned with insufficient accuracy and the direction of each nozzle is displaced from the predetermined one. For example, in a liquid jet printing apparatus with a plurality of liquid jet print heads for full-color printing, if one print head is installed in a tilted state with respected the other heads, the dots from the tilted head overlap those from other heads, and the quality of printed images may degrade seriously. Similarly, when a single print head is used for printing, if the print head is tilted beyond a limit, the image quality may also degrade seriously. In particular, in the case of a serial type liquid jet printing apparatus using an elongated print head, the mismatch in boundaries between scanning regions becomes conspicuous.

For these reasons, the amount of tilting of nozzles (nozzle array) in the print head with respect to the printing apparatus (carriage) must be as close as possible to a predetermined level when the print head is installed in a liquid jet printing apparatus. To achieve this, projections are provided with the frame serving as the casing of the liquid jet print head. The liquid jet print head is positioned in the printing apparatus by engaging the projections with predetermined positions of the carriage. However, since the casing of the print head, which usually has a complex shape, is typically made of resin, the projection may deform because of insufficient rigidity. Deformation of the projection may deteriorate the positioning accuracy of the liquid jet print head and the positioning repeatability at installing and replacing the print head.

Accuracy in the amount of tilting of the nozzles of the print head with respect to the printing apparatus (carriage) is determined by the positioning accuracy of the printing device substrate (or a orifice plate) including nozzles as well as the installing accuracy of the liquid jet print head in the predetermined position of the carriage. Thus, in order to solve the above problems associated with the quality of printed images, it is very important to improve the positioning accuracy of the nozzles (array of nozzles) in the liquid jet print head, that is, the installing accuracy of the printing device substrate or the orifice plate in the predetermined positions of the print head.

However, as described above, it is difficult to prevent the increase of positioning errors because a number of components including the member having nozzles, the casing and the like are assembled to complete a liquid jet print head. For example, in a liquid jet print head where a plurality of printing device substrates are installed, each of printing device substrates must be fixed to the supporting substrate with high accuracy using semiconductor mounting techniques. In addition, even in a liquid jet print head using a single printing device substrate, expensive materials are required for the print head and the carriage, and machining of high accuracy is required. If strictly controlling the dimensional accuracy of the liquid jet print head and the carriage and the installing accuracy of the print head on the carriage for maintaining the quality of printed images, the manufacturing yield of the print heads and apparatuses may decrease and thus their manufacturing efficiency may decrease. At the same time, the costs of the liquid jet print head and apparatus may increase.

SUMMARY OF THE INVENTION

The present invention provides a liquid jet print head and a liquid jet printing apparatus capable of easily improving various accuracies required to maintain the quality of printed images high, improving productivity and reducing cost.

A liquid jet print head of the invention comprises a printing unit including: a printing device array having a plurality of nozzles for ejecting print liquid and a plurality of printing devices; and a supporting member, to which the printing device array is attached, having a print liquid flow path for supplying print liquid to the printing device array, the printing unit adapted to be capable of sending electric signals for printing to the printing device array; and a print liquid storage unit connectable to the printing unit, the print liquid storage unit storing print liquid for the printing unit, wherein the supporting member is formed to define a reference plane for determining the amount of tilting of an array of the nozzles with respect to the supporting member when the printing device array is aligned and fixed to a predetermined position of the supporting member, and wherein the reference plane can be used as a reference for positioning when the print head is installed in the liquid jet printing apparatus.

Another liquid jet print head of the invention comprises a printing unit including a first-direction reference portion, a second-direction reference portion and a third-direction reference portion, which can be used as three-dimensional positioning references when the print head is installed in the liquid jet printing apparatus. In this print head, a reference for positioning to align and fix the printing device array in a predetermined position of the supporting member is used as at least one of the first-direction reference portion, the second-direction reference portion and the third-direction reference portion.

Another liquid jet print head of the invention comprises a printing device substrate having an array of a plurality of nozzles for ejecting print liquid and a plurality of printing devices arranged in correspondence with the plurality of nozzles; and a supporting member for supporting the printing device substrate and having a print liquid flow path for supplying print liquid to the nozzles, wherein the supporting member includes a plurality of projections arranged along the array of nozzles, the projection capable of being in contact with a predetermined position of the liquid jet printing apparatus when the print head is installed in the liquid jet printing apparatus.

The liquid jet printing apparatus of the invention comprises one of the above liquid jet print heads.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
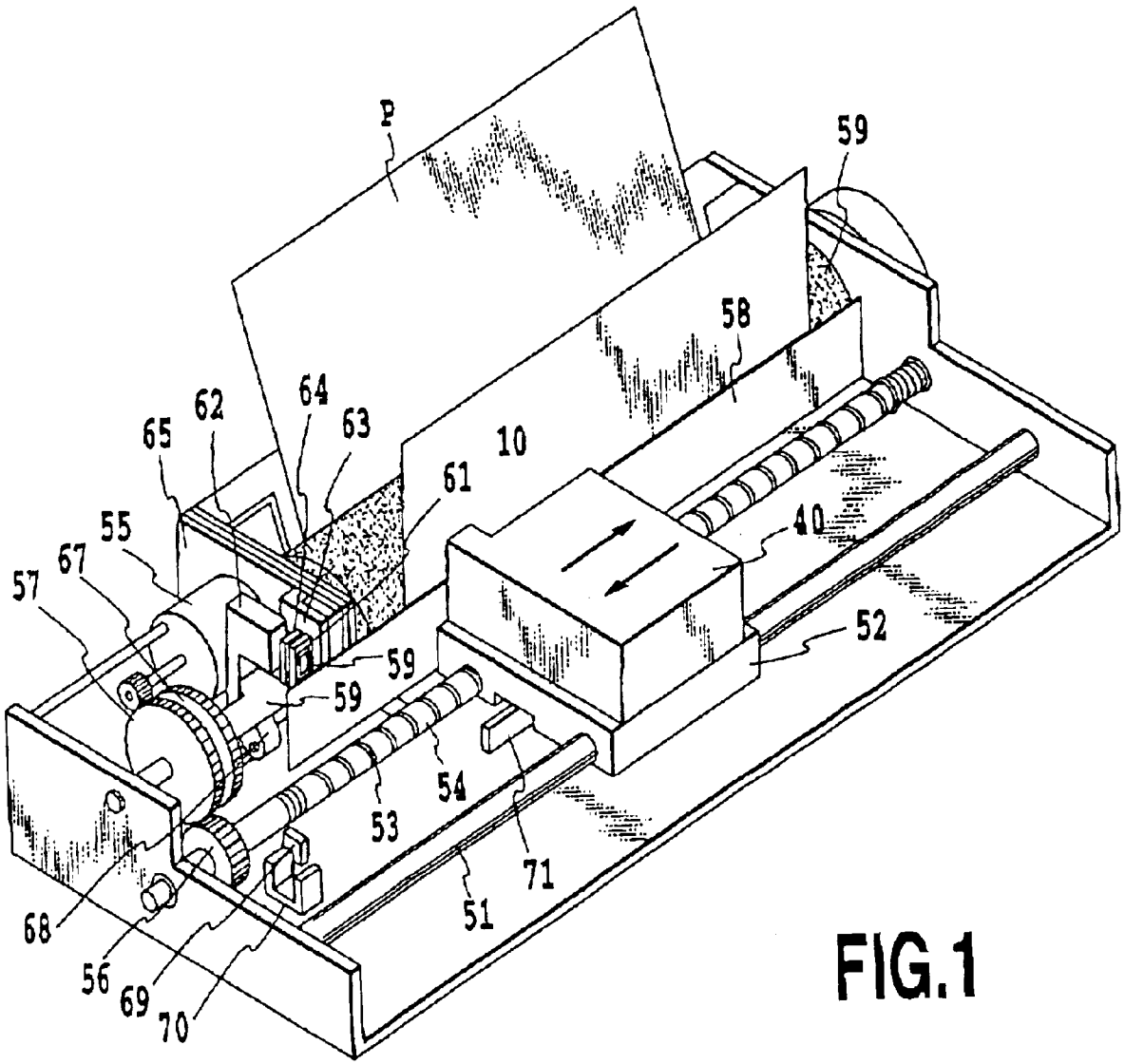
FIG. 1 is a perspective view illustrating an example of the liquid jet printing apparatus of the invention.

One aspect of the invention relates to a liquid jet print head capable of being installed in the liquid jet printing apparatus. The liquid jet print head has a printing unit that produces liquid drops for printing and a print liquid storage unit connectable to the printing unit and storing print liquid for the printing unit. The printing unit includes a printing device array having a plurality of nozzles for ejecting print liquid and a plurality of printing devices, and a supporting member having a print liquid flow path for Supplying print liquid to the printing device array. The printing device array is attached to the supporting member. The printing unit is adapted to send electric signals for printing to the printing device array. The supporting member of the printing unit is formed to define a predetermined reference plane. By this reference plane, the amount of tilting of an array of the nozzles (nozzle array) with respect to the supporting member can be determined when the printing device array is aligned and fixed in a predetermined position of the supporting member. This reference plane also serves as a positioning reference for installing the liquid jet print head in the liquid jet printing apparatus. The reference plane can be defined by, for example, two projections formed on the side face of the supporting member.

In the liquid jet print head of the invention, the reference plane defined by the supporting member of the printing unit serves as both a positioning reference for mounting the printing device array on the supporting member and that for installing the print head in the printing apparatus. Thus, the amount of tilting of the nozzle array with respect to the printing apparatus is precisely controlled when the liquid jet print head is installed in the printing apparatus, so that the nozzle array can be positioned in printing apparatus With high accuracy.

For example, if a printing apparatus capable of full-color printing has a plurality of liquid jet print heads of the invention, it is possible to make difference in the amount of tilting of the nozzle array between the liquid jet print heads relatively small. Thus, the liquid drops of each color precisely reach predetermined positions on the print medium so that the quality of printed images can be improved significantly. Further, if a printing apparatus with single-piece print heads has a liquid jet print head of the invention, the quality of printed images can also be significantly improved; for example, ruled lines can be drawn in the precise horizontal direction. That is, the liquid jet print head of the invention is particularly useful if employed in a printing apparatus of which nozzle array is rather long and in a printing apparatus driven with a high frequency. If the liquid jet print head of the invention is employed in a serial type liquid jet printing apparatus, the mismatch in the boundaries between scanning regions can be significantly reduced.

Preferably, the printing device array is a printing device substrate having an array of a plurality of nozzles for ejecting print liquid and an array of plurality of printing devices.

Such a printing device substrate is manufactured with its nozzle array being precisely positioned with respect to the printing devices. Further, the printing device array is fixed to the supporting member with its amount of tilting with respect to the supporting member being precisely controlled using the reference plane. Thus, the amount of tilting of the nozzle array in the print head can be set precisely. The print head is installed in the liquid jet printing apparatus using the reference plane again, so that the tilting of the nozzle array with respect to the printing apparatus can also be set at a desired value.

The printing device array may include an orifice plate having an array of a plurality of nozzles and a substrate having a plurality of printing devices arranged in correspondence to the nozzles of the orifice plate. The substrate is attached to the supporting member. The reference plane is defined by the supporting member and determines the amount of tilting of the nozzle array of the orifice plate with respect to the supporting member when the orifice plate is aligned and fixed to a predetermined position of the substrate attached to the supporting member.

In this case, the orifice plate is fixed to the supporting member with its amount of tilting with respect to the supporting member being controlled precisely using the reference plane, so that the amount of tilting of the nozzle array in the print head can be precisely set. The print head is installed in the printing apparatus using the reference plane again, so that the tilting of the nozzle array with respect to the printing apparatus can also be set at a desired value.

Preferably, the supporting member is a supporting substrate attached to a main body of the printing unit.

Because such a supporting substrate has a plate-like shape, it is relatively easy to set geometric parameters (parallelism between the device mounting face of the printing device substrate and the opposite face, and surface evenness) at precise values. Then, it becomes eventually possible to simplify the structure of a means (jig) for attaching the printing device array to the supporting member, and to keep the accuracy of mounting the supporting substrate onto the means for the attachment high. As a result, the printing device array (the printing device substrate, or the orifice plate and the substrate) can be precisely aligned and fixed the supporting member.

The reference plane may be defined along one side face of the supporting substrate and extends substantially in parallel with the array of nozzles.

This makes an alignment of the printing device array with respect to the supporting substrate in the means for attaching the printing device array to the supporting member. In this structure, the work mounting space can also be saved, so that the cost of the means for the attachment can be reduced and the productivity can be improved.

In addition, the length of the reference plane in the longitudinal direction is longer than the length of the array of nozzles.

This makes it easy to adjust the amount of tilting of the printing device array with respect to the reference plane defined by the supporting substrate during the alignment of the printing device array with respect to the supporting substrate, and eventually the alignment accuracy and productivity can be improved.

Further, the liquid jet print head includes two reference planes, one reference plane defined along a first side face of the supporting substrate and the other reference plane defined along a second side face of the supporting substrate substantially perpendicular to the first side face. In such a structure, the supporting substrate defines two reference planes. One of the two reference planes is used as both the positioning reference for the nozzle array in the print head and the positioning reference for the print head with respect to the printing apparatus. The other reference plane is used as a positioning reference for the print head with respect to the printing apparatus.

This makes it possible to precisely control the amount of tilting of the nozzle array, and the position of the nozzle array when installing the print head in the printing apparatus. The liquid jet print head having such a structure is particularly useful if employed in a liquid jet printing apparatus where a plurality of liquid jet print heads are installed. In such a case, accuracy of positioning print heads can be remarkably improved, and the reliability of the liquid jet printing apparatus and the quality of printed images can be significantly improved.

The supporting substrate may be made of rigid material such as ceramics and alumina so as to reduce deformation and wear. The supporting substrate of the rigid material can define uniform reference plane. Even if the liquid jet print head is frequently installed to or detached from the printing apparatus, the amount of tilting of the nozzle array is precisely determined with high positioning repeatability when the print head is installed in the printing apparatus. As a result, the reliability of the liquid jet printing apparatus can also be improved.

If the supporting substrate is made of ceramics, the supporting substrate can be manufactured with excellent dimensional and geometric tolerances. Thus, the printing device array and orifice plate can be mounted in the correct positions with high accuracy. In addition, if the supporting substrate is made of alumina, the overall thermal characteristics of the liquid jet print head where printing devices are densely arranged can be improved due to the excellent heat-dissipating capability of alumina. Excessive temperature rise in the print head is thereby prevented effectively.

Further, the printing unit may include a second-direction reference portion and a third-direction reference portion. The second-direction reference portion is used as a reference for positioning in a second direction substantially perpendicular to a first direction in which the reference plane extends when the print head is installed in the liquid jet printing apparatus. The third-direction reference portion is used as a reference for positioning in a third direction substantially perpendicular to first and second directions when the print head is installed in the liquid jet printing apparatus.

Preferably, the printing device includes an electrothermal converting element and ejects print liquid drops using thermal energy generated by the electrothermal converting element.

Another aspect of the invention also relates to a liquid jet print head capable of being installed in a liquid jet printing apparatus. The liquid jet print head has a printing unit that produces liquid drops for printing and a print liquid storage unit connectable to the printing unit and storing print liquid for the printing unit. The printing unit includes a printing device array having a plurality of nozzles for ejecting print liquid and a plurality of printing devices, and a supporting member having a print liquid flow path for supplying print liquid to the printing device array. The printing device array is attached to the support member. The printing unit is adapted to send electric signals for printing to the printing device array. The printing unit includes a first-direction reference portion, a second-direction reference portion and a third-direction reference portion, which can be used as three-dimensional positioning references when the print head is installed in the liquid jet printing apparatus. In such a structure, a reference for positioning to align and fix the printing device array in a predetermined position of the supporting member is used as at least one of the first-direction reference portion, the second-direction reference portion and the third-direction reference portion.

In this print head, all of the three-dimensional positioning references, which may be used for installing the print head in the printing apparatus, are integrated in the printing unit. Compared with the case where three-dimensional positioning references are separated into the printing unit and print liquid storage unit, if they are integrated in the print unit, the head positioning errors due to assembling and/or dimensional errors of its components are reduced and thus the print head can be position in the correct position more precisely. Thus, the nozzle array can be precisely positioned when the liquid jet print head is installed in the liquid jet printing apparatus. Further, the positioning reference for mounting the printing device array in the predetermined position of the supporting member of the printing unit is also used as the positioning reference for installing the liquid jet print head in the printing apparatus. As a result, the amount of tilting of the nozzle array, which is the most important factor when the liquid jet print head is installed in the printing apparatus, can be controlled very precisely.

In this liquid jet print head, the components that need high-precision machining, special material and high mechanical strength may be limited to those used in the positioning references. Thus, the dimensional tolerance and reliability of the assembled liquid jet print head can be easily improved, and the cost of the liquid jet print head can be reduced. That is, if the printing unit includes a minimum set of components that satisfy the required performance for the print head, the print liquid storage unit may be made of inexpensive and conventional material, and the total cost of the liquid jet print head can be appropriately distributed to each component. Furthermore, there is no need to form positioning references in the print liquid storage unit in this print head. Thus, the design of the liquid storage unit becomes flexible, and it becomes easy to enlarge the capacity of the liquid jet print head. In addition, if the printing unit is downsized, the means for attaching the printing device array to the supporting member can also be downsized, and the productivity of liquid jet print heads can be improved.

The printing unit may include a supporting substrate fixed thereto as the supporting member. In this case, a reference for positioning to align and fix the printing device array in a predetermined position of the supporting substrate is used as one of the first-direction reference portion, the second-direction reference portion and the third-direction reference portion.

Furthermore, a pressing force for contacting the first-direction reference portion, the second-direction reference portion and the third-direction reference portion to predetermined positions is received by the print liquid storage unit.

In order to increase the capacity of the print liquid in the liquid jet print head, the print head itself must be enlarged to incorporate a large amount of print liquid. Then, the pressing force applied to the print head increases when a liquid jet print head is mounted in a printing apparatus. On the other hand, in this print head, the print liquid storage unit receives all the pressing forces in the three directions. Thus, it is unnecessary to enlarge the printing unit. Further, this liquid jet print head can be manufactured at low cost and the productivity can be raised, because it is possible to minimize the printing unit size in this print head.

Preferably, the printing device includes an electrothermal converting element and ejects print liquid drops using thermal energy generated by the electrothermal converting element.

Another aspect of the invention also relates to a liquid jet print head comprising: a printing device substrate having an array of a plurality of nozzles for ejecting print liquid and a plurality of printing devices arranged in correspondence with the plurality of nozzles; and a supporting member for supporting the printing device substrate and having a print liquid flow path for supplying print liquid to the nozzles. In this print head, the supporting member includes a plurality of projections arranged along the array of nozzles. The projection can be in contact with a predetermined position of the liquid jet printing apparatus when the print head is installed in the liquid jet printing apparatus.

Another aspect of the invention relates to a liquid jet printing apparatus comprising: a liquid jet print head capable of ejecting print liquid; and a carriage supporting the liquid jet print head and capable of being scanned in a main scanning direction, the carriage being scanned to form an image on a print medium by ejecting print liquid from the print head. The liquid jet print head comprises: a printing unit including: a printing device array having a plurality of nozzles for ejecting print liquid and a plurality of printing devices; and a supporting member, to which the printing device array is attached, having a print liquid flow path for supplying print liquid to the printing device array, the printing unit adapted to be capable of sending electric signals for printing to the printing device array; and a print liquid storage unit connectable to the printing unit, the print liquid storage unit storing print liquid for the printing unit. The supporting member is formed to define a reference plane for determining the amount of tilting of an array of the nozzles with respect to the supporting member when the printing device array is aligned and fixed to a predetermined position of the supporting member. The reference plane can be used as a reference for positioning when the print head is installed in the liquid jet printing apparatus.

Another aspect of the invention also relates to a liquid jet printing apparatus comprising; a liquid jet print head capable of ejecting print liquid; and a carriage supporting the liquid jet print head and capable of being scanned in a main scanning direction, the carriage being scanned to form an image on a print medium by ejecting print liquid from the print head. The liquid jet print head comprises: a printing unit including: a printing device array having a plurality of nozzles for ejecting print liquid and a plurality of printing devices; and a supporting member, to which the printing device array is attached, having a print liquid flow path for supplying print liquid to the printing device array, the printing unit adapted to be capable of sending electric signals for printing to the printing device array; and a print liquid storage unit connectable to the printing unit, the print liquid storage unit storing print liquid for the printing unit. The printing unit includes a first-direction reference portion, a second-direction reference portion and a third-direction reference portion, which can be used as three-dimensional positioning references when the print head is installed in the carriage. In this printing apparatus, a reference for positioning to align and fix the printing device array in a predetermined position of the supporting member is used as at least one of the first-direction reference portion, the second-direction reference portion and the third-direction reference portion.

Another aspect of the invention also relates to a liquid jet printing apparatus comprising: a plurality of liquid jet print heads, each of the print heads including: a printing device substrate having an array of a plurality of nozzles for ejecting print liquid and a plurality of printing devices arranged in correspondence with the plurality of nozzles; and a supporting member for supporting the printing device substrate and having a print liquid flow path for supplying print liquid to the nozzles. The supporting member includes a plurality of projections arranged along the array of nozzles, the projection capable of being in contact with a predetermined position of the liquid jet printing apparatus when the print head is installed in the liquid jet printing apparatus. The print heads are installed in the liquid jet printing apparatus so that the arrays of nozzles are in parallel with each other.

Now, preferred embodiments of the liquid jet print head and liquid jet printing apparatus of the invention will be described in detail with reference to the accompanying drawings.

FIG. 1 is a perspective view illustrating a liquid jet printing apparatus with a liquid jet print head (hereinafter, also called the print head) of the invention. This drawing exemplifies an inkjet printer 1 as a liquid jet printing apparatus of the invention. The inkjet printer 1 has a liquid jet print head 50 that can eject print liquid and a carriage 2 that supports the liquid jet print head 50 and is scanned in the main scanning direction. The inkjet printer 1 forms images on a print medium P by scanning the carriage 2 and ejecting ink (print liquid) from the liquid jet print head 50.

As shown in FIG. 1, a print head 50 is installed on the carriage 2 that is supported by a lead screw 3 and a guide rail 4. The lead screw 3 has a screw groove 3*a* thereon, and this screw groove 3*a* engages with a pin (not shown) of the carriage 2. The lead screw 3 is rotatably supported by the casing 5 of the inkjet printer 1 and driven by a motor M via a gear train including a gear G1. When the screw 3 is rotated by the motor M in the forward or inverse direction, the carriage 2 reciprocates along the guide rail 4

The Print medium P is transported by a platen roller 6 to the printing position facing the print head 50. Within the casing 5, a pressing unit 7 for pressing the print medium P onto the platen roller 6 is disposed over the range where the carriage 2 moves. In the vicinity of one end of the lead screw 3 (in the vicinity of gear G1), a home position is determined where photo-couplers 8*a* and 8*b* are disposed. These photo-couplers 8*a* and 8*b* serve as home-position detector. When the photo-couplers 8*a* and 8*b* detect the lever 2*a* of the carriage 2, they generate signals for controlling the rotational direction of the motor M.

Additionally, near the home position, a cap unit 9 for capping the front face of the print head 50, a ejection recovery unit 10 and a cleaning blade 11 are disposed. In the inkjet printer 1, an ejection recovery operation is performed on the print head 50 placed in the home position at a predetermined timing by the ejection recovery unit 10 through an opening 9*a* of the cap unit 9. The cleaning blade 11 moves back and forth with respect to the print head 50 at a predetermined timing to remove ink drops and micro paper pieces adhering to the print head 50.

In the above inkjet printer 1, the print head 50 is detachably installed on the carriage 2 In order to obtain high quality printed images on the print medium P, it is necessary to set the amount of tilting of the nozzle array in the print head 50 for at a predetermined value when installing the print head 50 on the carriage 2. For this purpose, the liquid jet print head 50 of the invention has various features to maintain excellent positioning accuracy for the nozzle array of the print head 50. Now the liquid jet print head 50 of the invention is described in detail below.

Figure 2:
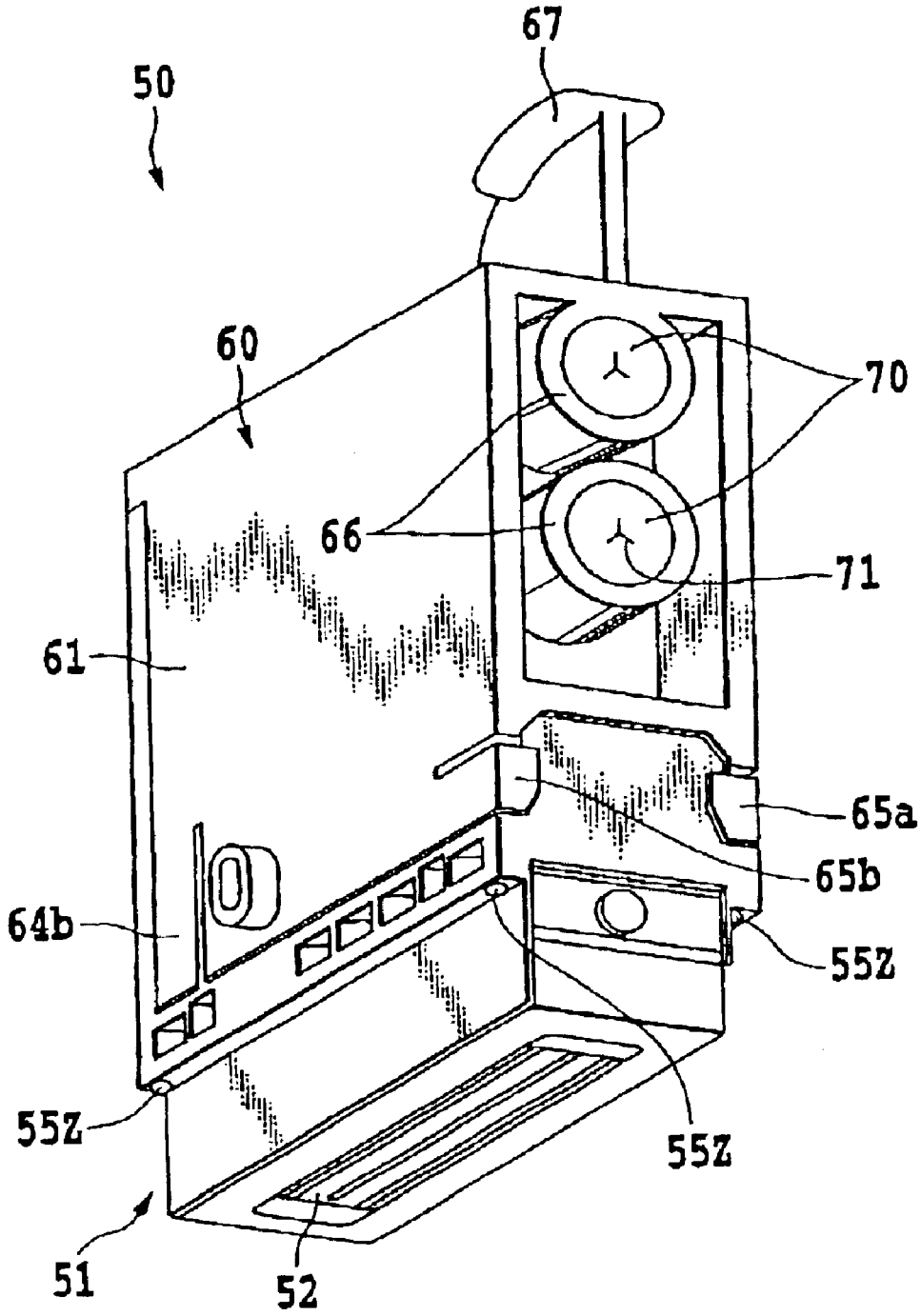
FIG. 2 is a perspective view illustrating a first embodiment of the liquid jet print head according to the invention.
Figure 3:
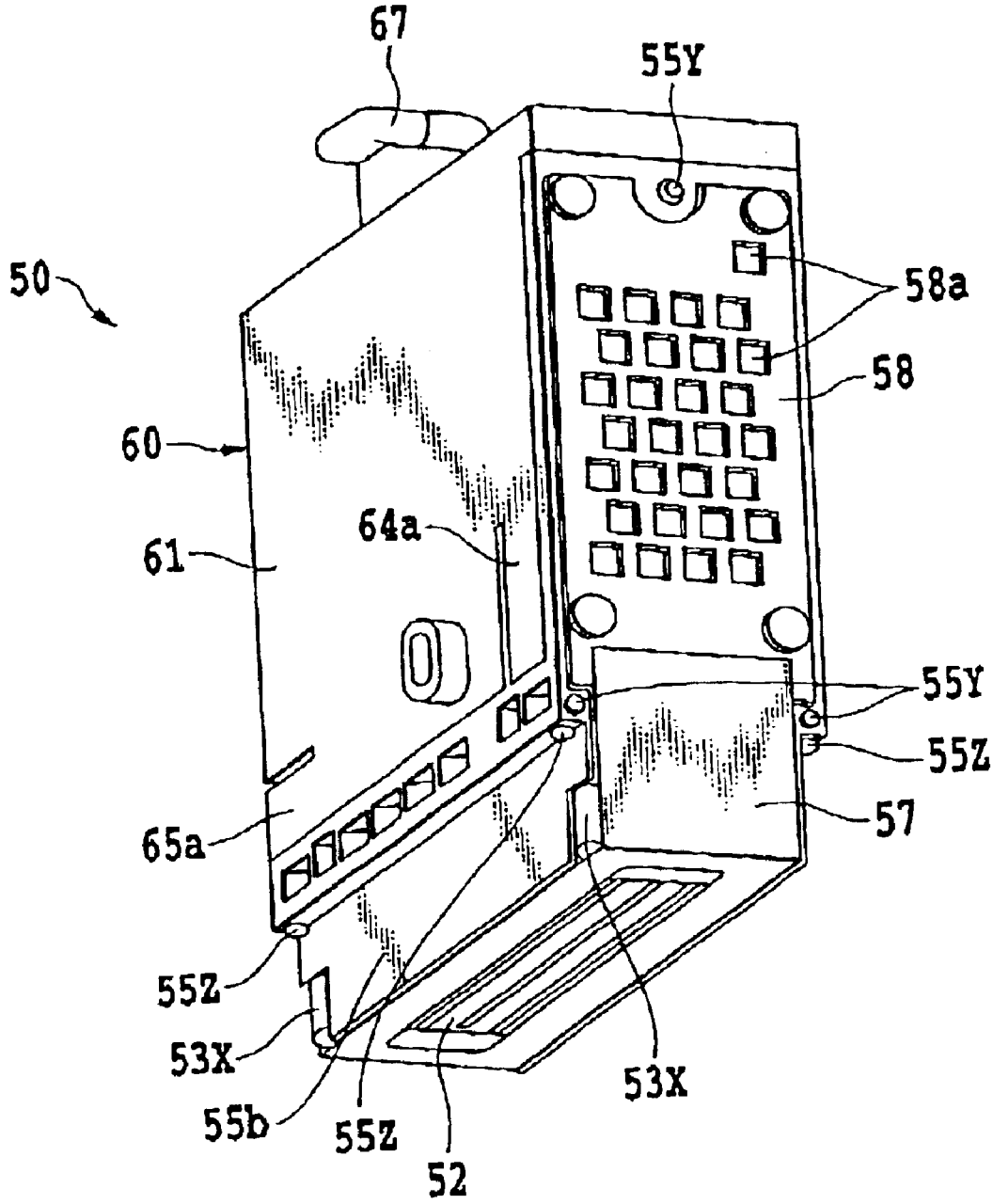
FIG. 3 is a perspective view illustrating a first embodiment of the liquid jet print head according to the invention.
Figure 4:
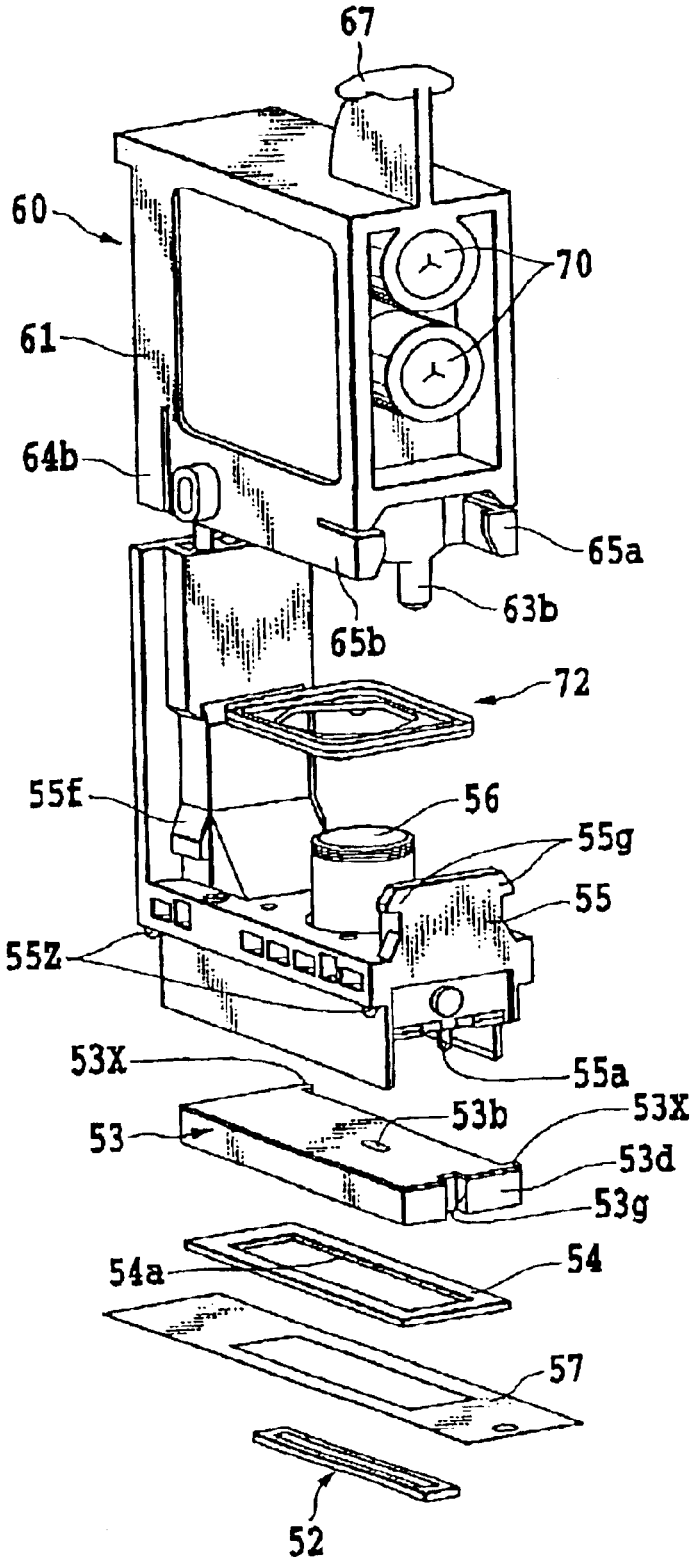
FIG. 4 is an explosive perspective view illustrating the liquid jet print head of FIGS. 2 and 3.
Figure 5:
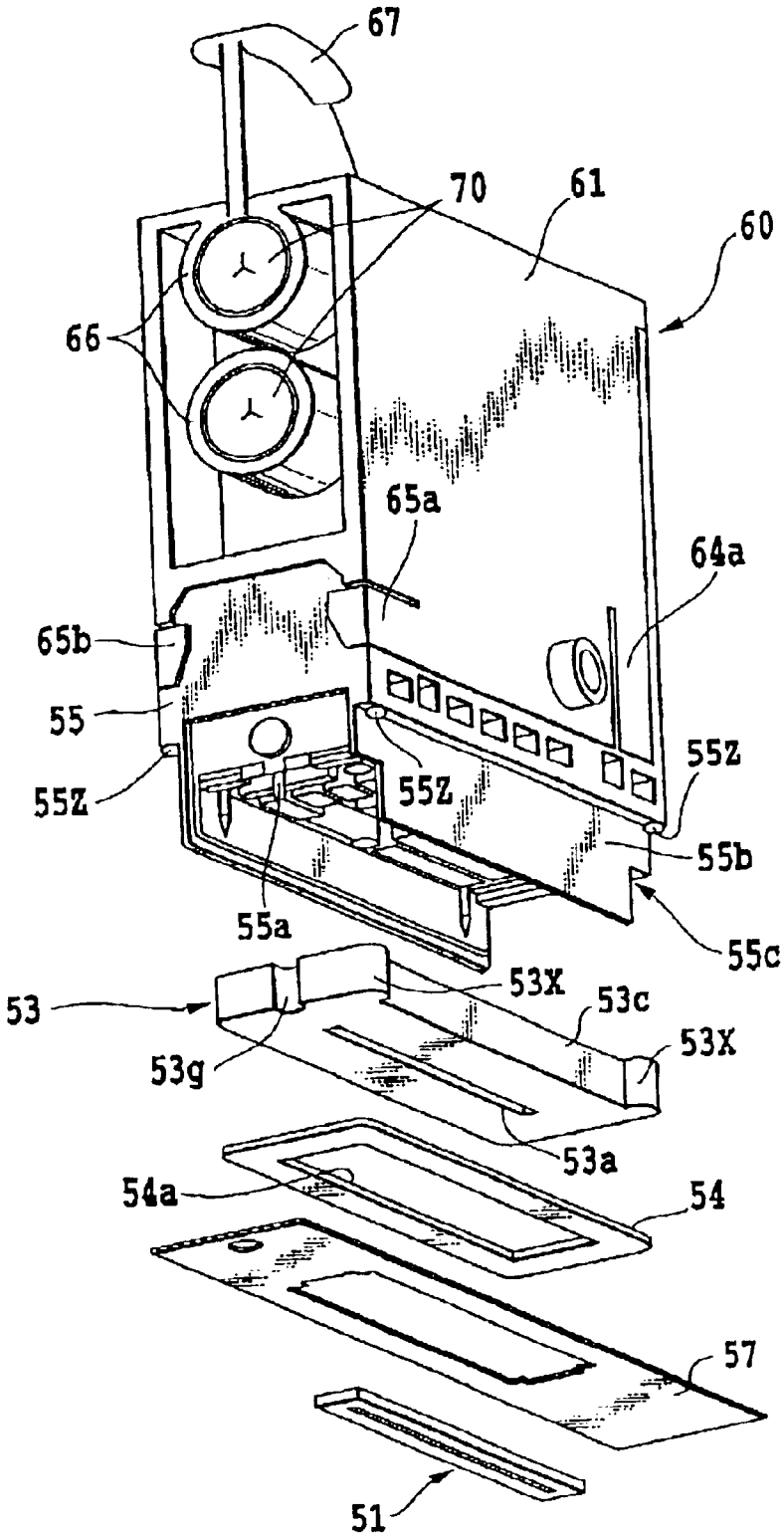
FIG. 5 is an explosive perspective view illustrating the liquid jet print head of FIGS. 2 and 3.
Figure 7:
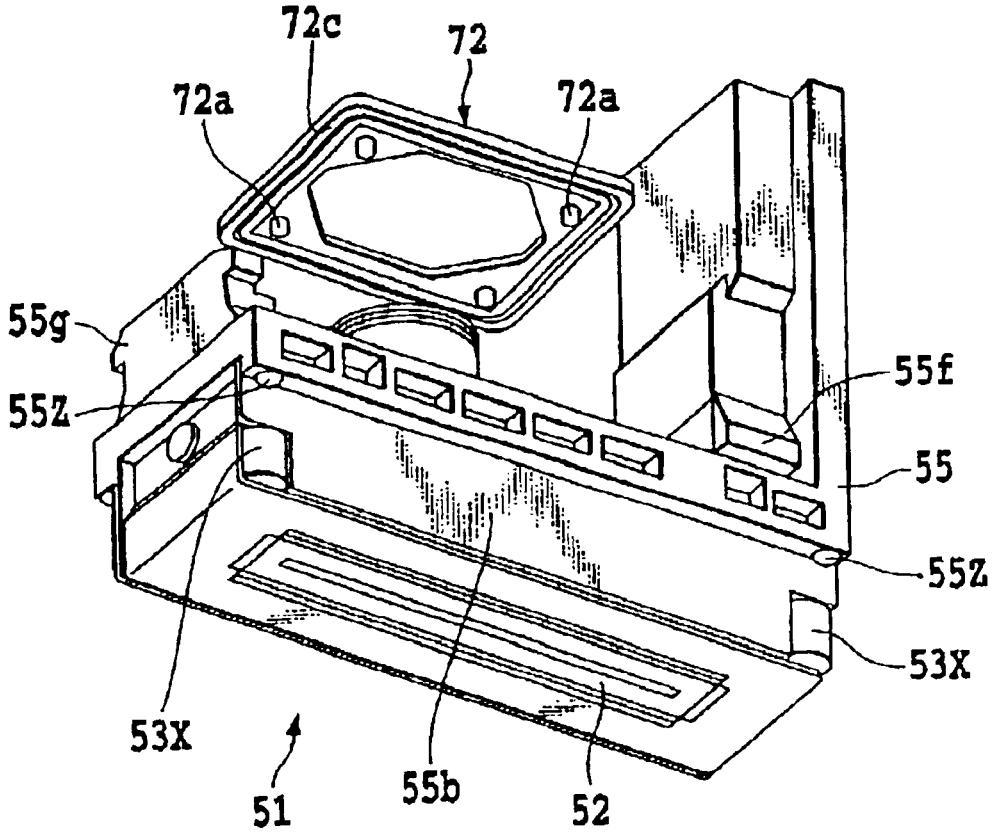
FIG. 7 is a perspective view illustrating the printing unit of the liquid jet print head of FIGS. 2 and 3.
Figure 8:
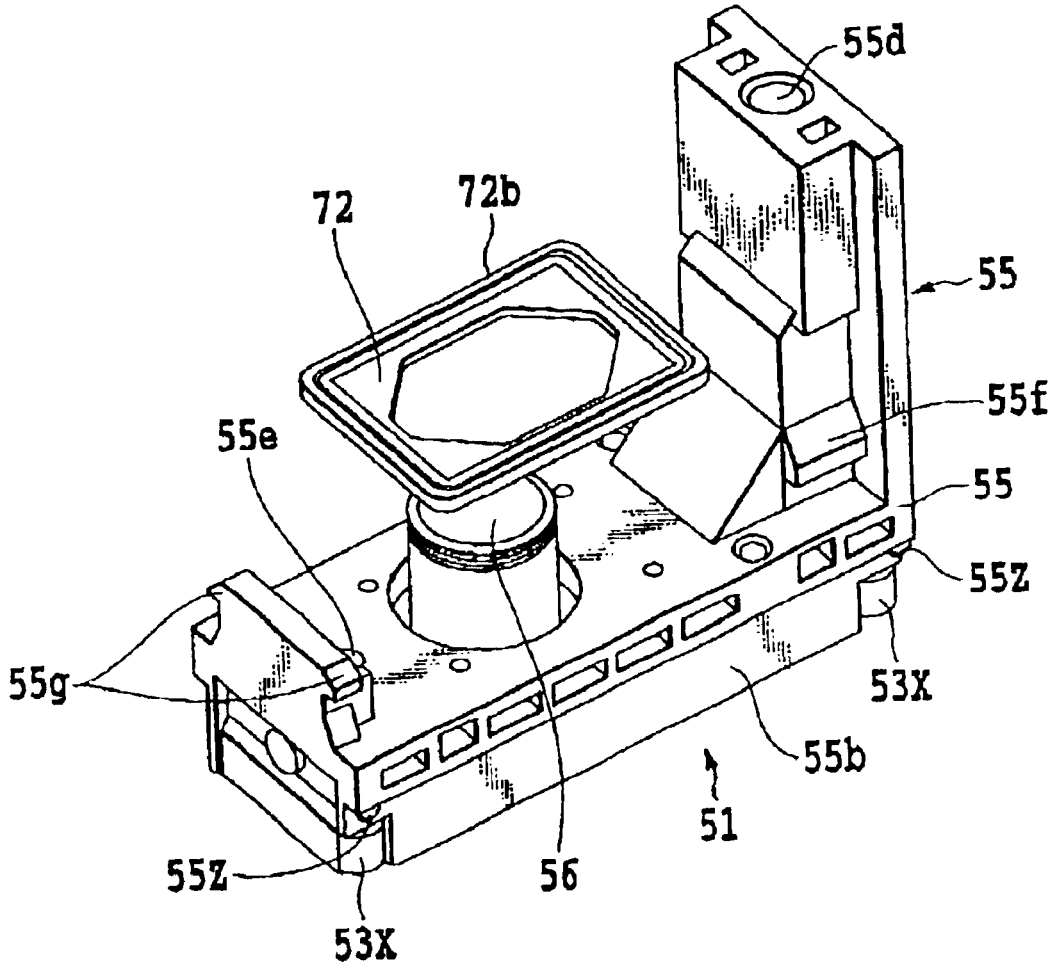
FIG. 8 is a perspective view illustrating the printing unit of the liquid jet print head of FIGS. 2 and 3.

FIGS. 2 and 3 are perspective views illustrating the liquid jet print head 50 and FIGS. 4 and 5 are exploded perspective views illustrating the liquid jet print head 50. As shown in these drawings, the print head 50 takes the form of a cartridge that can be detachably installed on the cartridge 2 of the inkjet printer 1. The print head 50 comprises a printing unit (head chip) 51 shown in FIGS. 6–8 and a print liquid storage unit 60 shown in FIG. 9. The printing unit 51 is detachably connectable to the print liquid storage unit 60 The print liquid storage unit 60 stores ink for the printing unit 51. The printing unit 51 produces ink drops for printing and eject them onto the print medium P.

As shown in FIGS. 2–5, the printing unit 51 includes a printing device substrate (printing device array) 52, supporting substrate (supporting member) 53, plate 54, flow path forming member (main body) 55, porous member (filter) 56, electric wiring substrate (electric wiring sheet) 57, and contact terminal wiring substrate 58. The printing device substrate 52 is a Silicon (Si) substrate on which a plurality of printing devices (electrothermal converting elements) for ejecting ink and aluminum wiring and the like (not shown) for providing electric power to each of printing devices are formed by thin film technology. Further, on the Silicon substrate, a plurality of print liquid flow paths (not shown) and a plurality nozzles 525 (array of nozzles 525A, see FIG. 11), both corresponding to the printing devices, are formed by high-precision lithography techniques. The printing device substrate 52 has a print liquid supply inlet 52*a* (FIG. 10) on its backside (on the side of the supporting substrate 53). The inlet 52*a* is used for supplying ink from the print liquid storage unit 60 to a plurality of print liquid flow paths that are connected to each of nozzles 525.

The printing device substrate 52 is attached (bonded) to the supporting substrate 53. The supporting substrate 53 is made of rigid material such as ceramics and alumina. The supporting substrate 53 has a print liquid flow path 53*a* through which ink is supplied to the printing device substrate 52. The print liquid flow path 53*a* leads to the inlet 53*b* (see FIG. 4) formed on the back (on the side of the flow path forming member 55) of the supporting substrate 53. A plate 54 is attached (bonded) to the supporting substrate 53 with adhesive or the like. The plate 54 has an opening 54*a* for isolating itself from the printing device substrate 52, and the printing device substrate 52 is disposed within the opening 54*a*. The supporting substrate 53 is fixed to the flow path forming member 55 with adhesive or screws.

As shown in FIGS. 4 and 6–8, the flow path forming member 55 has a substantially L-shape body and includes print liquid flow paths (not shown) therein for ink. When the supporting substrate 53 is fixed to the flow path forming member 55, their flow paths communicate each other via the inlet 53*b*. The porous member 56 is bonded to the flow path forming member 55 from the opposite side of the supporting substrate 53. This porous member 56 prevents dust from coming into print liquid from the upstream side, that is, the side of the print liquid storage unit 60.

The electric wiring substrate 57 is bonded on the top surface of the plate 54 of the supporting substrate 53. The electric wiring substrate 57 is electrically connected with each of printing devices of the printing device substrate 52. The electric wiring substrate 57 is also connected to a contact terminal wiring substrate 58 located on the back of the flow path forming member 55 by connection means such as ACF, lead bonding, wire bonding or connectors. The electric wiring substrate 57 and the contact terminal wiring substrate 58 constitute a series of electric wiring for applying electric signals to the printing device substrate 52 for ejecting ink drops. Alternatively, it is possible to use an electric wiring unit where the electric wiring substrate is integrated with the contact terminal wiring substrate.

The contact terminal wiring substrate 58 has a plurality of terminals 58*a* for receiving electric signals from the inkjet printer 1. The electric signals for image printing are sent from the inkjet printer 1 to each of printing devices of the printing device substrate 52 via the contact terminal wiring substrate 58 and sheet electric wiring substrate 57. When electric pulse signals are sent from the inkjet printer 1 to the electrothermal converting elements serving as printing devices of the liquid jet print head 50, thermal energy is given to ink so that bubbles are generated in ink. The pressure of the bubble pushes ink drops from the nozzles 525 of the print head 50.

In order to keep excellent positioning accuracy for the array of nozzles (nozzle array) 525A of the print head 50 of the inkjet printer 1, the printing unit 51 of the print head 50 has following features.

Figure 10:
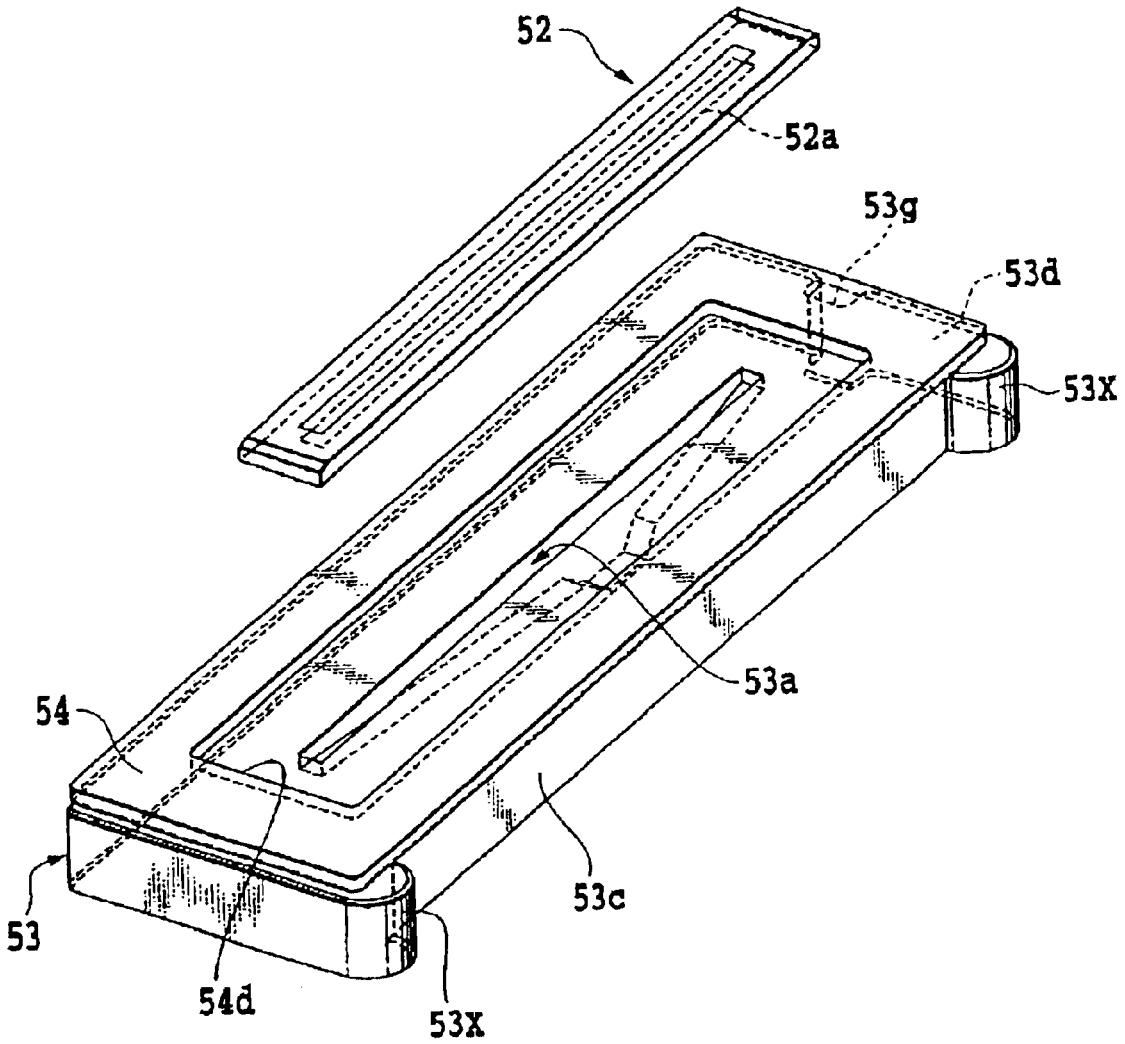
FIG. 10 is an enlarged perspective view illustrating an essential element the liquid jet print head of FIGS. 2 and 3.
Figure 11:
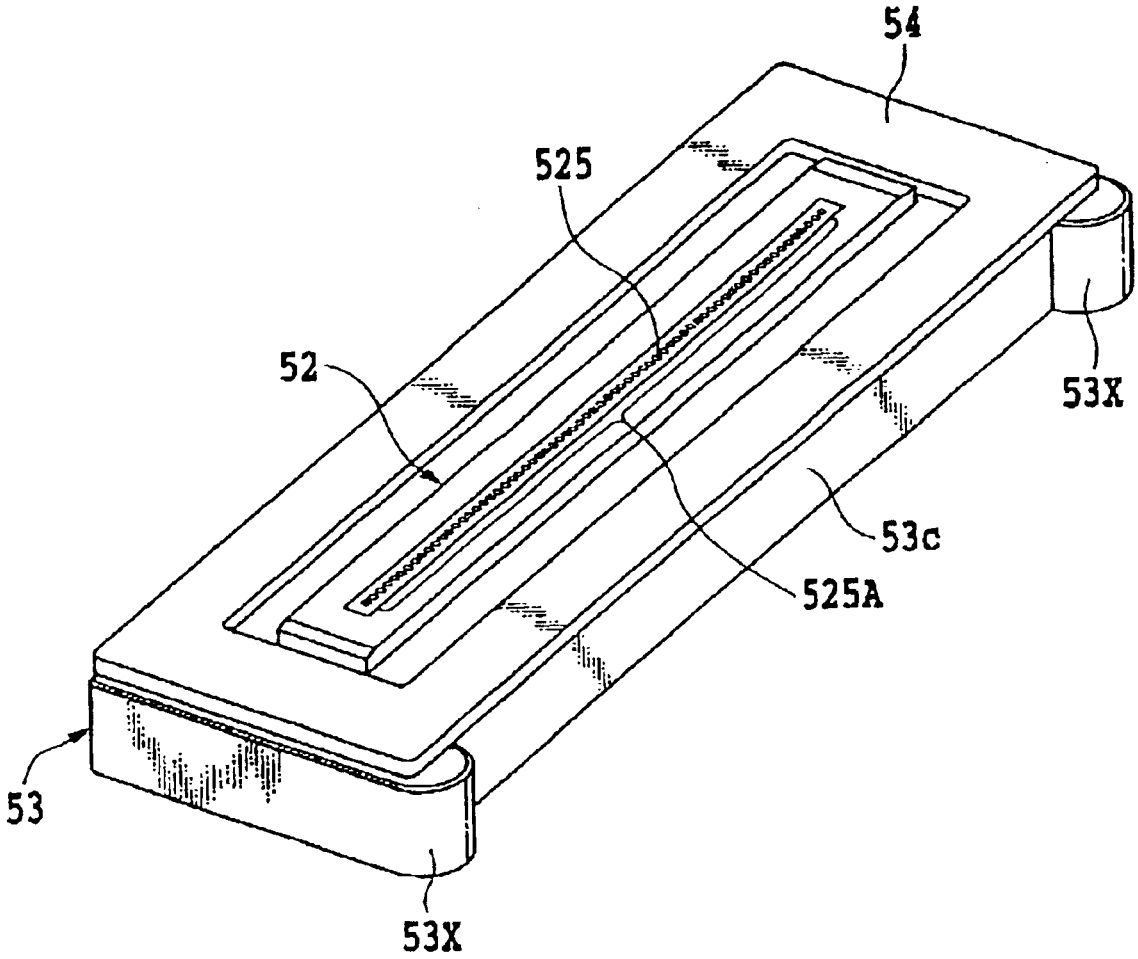
FIG. 11 is an enlarged perspective view illustrating an essential element of the liquid jet print head of FIGS. 2 and 3.

As shown in FIGS. 10 and 11, projections 53X are formed at both ends of one longitudinal side face 53*c* of the supporting substrate 53. Each of the projections 53X has a substantially semi-circular cross section. Each projection 53X projects by a predetermined length from the side face 53*c*. A reference plane is defined by connecting the ridge lines (see the dot-dash lines in FIG. 11) of the projections 53X. A groove 53*g* (see FIG. 11) of which cross section is substantially semi-circular is formed in the center of the side face 53*d* perpendicular to the longitudinal side face 53*c* of the supporting substrate 53.

When the printing device substrate 52 is fixed to the top face of the supporting substrate 53, the printing device substrate 52 is aligned with respect to the supporting substrate 53 using the reference plane defined by the projections 53X and the groove 53*g* (ridge lines of the projections 53X) of the supporting substrate 53. As a result, it is possible to correctly set the position and the amount of tilting of the nozzle array 525A (printing device array) of the substrate 52 with respect to the supporting substrate 53. Then, the printing device substrate 52 is bonded to the supporting substrate 53 by semiconductor mounting technology with high accuracy. As a result, the printing device substrate 52 is fixed to the supporting substrate 53, with its nozzle array 525A being correctly positioned with respect to the supporting substrate 53.

In the present embodiment, because the supporting substrate 53 has a plate-like shape, its geometric preciseness, that is, the parallelism between the device-mounting face and the opposing face and their evenness can be kept high. Eventually, a jig for bonding the printing device substrate 52 to the supporting substrate 53 can be simplified, and the supporting substrate 53 can be mounted onto a correct position of the jig. As described above, the printing device substrate 52 is more precisely aligned with respect to the supporting substrate 53, so that the amount of tilting the printing device substrate 52 with respect to the supporting substrate 53 can also be precisely controlled. As a result, the productivity of the print heads 50 is improved.

The above described reference plane is defined along side face 53*c* of the supporting substrate 53 extending in parallel to the direction of the nozzle array 525A. This makes it easy to align the printing device substrate 52 with respect to the supporting substrate 53 when the printing device substrate 52 is fixed to the supporting substrate 53. Further, in this case, the work mounting space of the jig can be smaller in comparison with the case where the reference plane is perpendicular to the nozzle array. As a result, the cost of the jig can be reduced and the productivity can also be improved. The time for assembly can also be shortened, because it becomes easy to align the printing device substrate with respect to the supporting substrate 53.

In addition, as seen from in FIG. 11, the longitudinal length of the reference plane defined by two projections 53X (the distance between the rigid lines of the faces of the projections 53X) is larger than the length of the nozzle array 525A. Accordingly, when the printing device substrate 52 is aligned with respect to the supporting substrate 53, the amount of tilting of the printing device substrate 52 with respect to the reference plane defined by the supporting substrate 53 can be easily adjusted. As a result, the alignment accuracy and productivity are improved.

The supporting substrate 53 to which the printing device substrate 52 is bonded precisely is fixed to the flow path forming member 55 using the groove 53*g* and the side face 53*c*. The flow path forming member 55 includes a projection 55*a* formed so as to fit in the groove 53*g* of the supporting substrate 53. One of the side walls 55*b* on the bottom side of the flow path forming member 55 has notches 55*c* in which the projections 53X of the supporting substrate 53 fit. The supporting substrate 53 is positioned and fixed to the flow path forming member 55 precisely in the right position using the groove 53*g* of the supporting substrate 53, projection 53*c* of the flow path forming member 55, inner surface of the side wall 55*b* of the flow path forming member 55 and the side face 53*c* (the face between the two projections 53X) of the supporting substrate 53. As a result, the relative position of the nozzle array 525A (the position of the printing device substrate 52) to the printing unit 51 can be determined very precisely.

When the supporting substrate 53 is fixed to the flow path forming member 55, as shown in FIG. 3, two projections 53X are exposed from the notches 55*c* to outside the side wall 55*b* of the flow path forming member 55. These two projections 53X of the supporting substrate 53 are also used as positioning references when the print head 50 is installed onto the cartridge 2 of the inkjet printer 1. In other words, the two projections 53X of the supporting substrate 53 serve as one of the three-dimensional positioning references (positioning reference in first direction X, or the first-direction reference portion) that will be needed when the print head 50 is installed in the inkjet printer 1.

Figure 6:
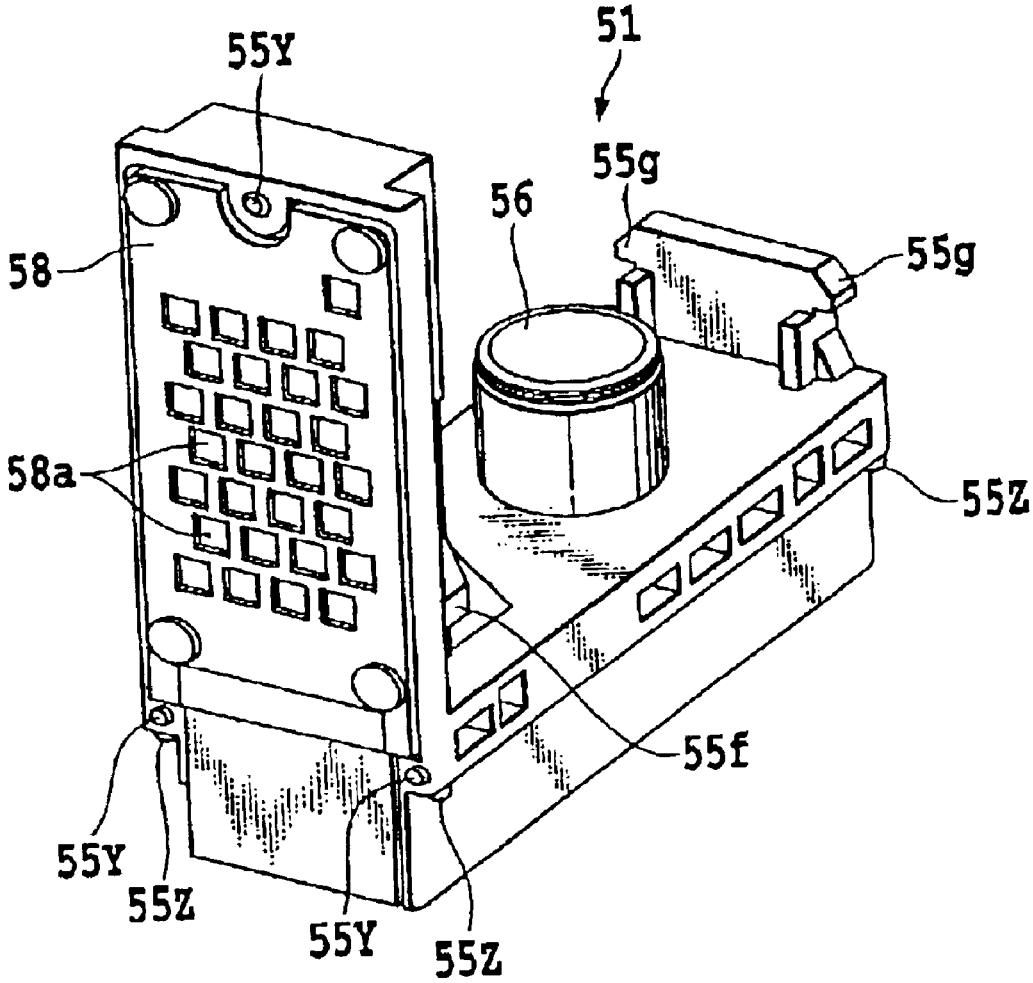
FIG. 6 is a perspective view illustrating the printing unit of the liquid jet print head of FIGS. 2 and 3.

In the print head 50 of the invention, the rest two positioning references are included in the flow path forming member 55. As shown in FIG. 6, on the back of the flow path forming member 55, one positioning projection 55Y is formed in the top, and two in the bottom. In the three-directional positioning references, these positioning projections 55Y serve as a second positioning reference portion in second direction Y which is perpendicular to first direction X. As shown in FIG. 3, four semi-spherical bosses (projections) 55Z projecting in the direction parallel to the side wall 55*b* are formed near the root of each side wall 55*b* of the flow path forming member 55 (four corners). In the three-dimensional positioning references, these semi-spherical bosses 55Z serve as a positioning reference portion in third direction Z which is perpendicular to the first direction X and the second direction Y. In this way, in the print head 50 of the invention, all the three-dimensional positioning reference portions 53X, 55Y and 55Z, which are used during installation of the print head 50 in the inkjet printer 1, are gathered in the printing unit 51.

Figure 9:
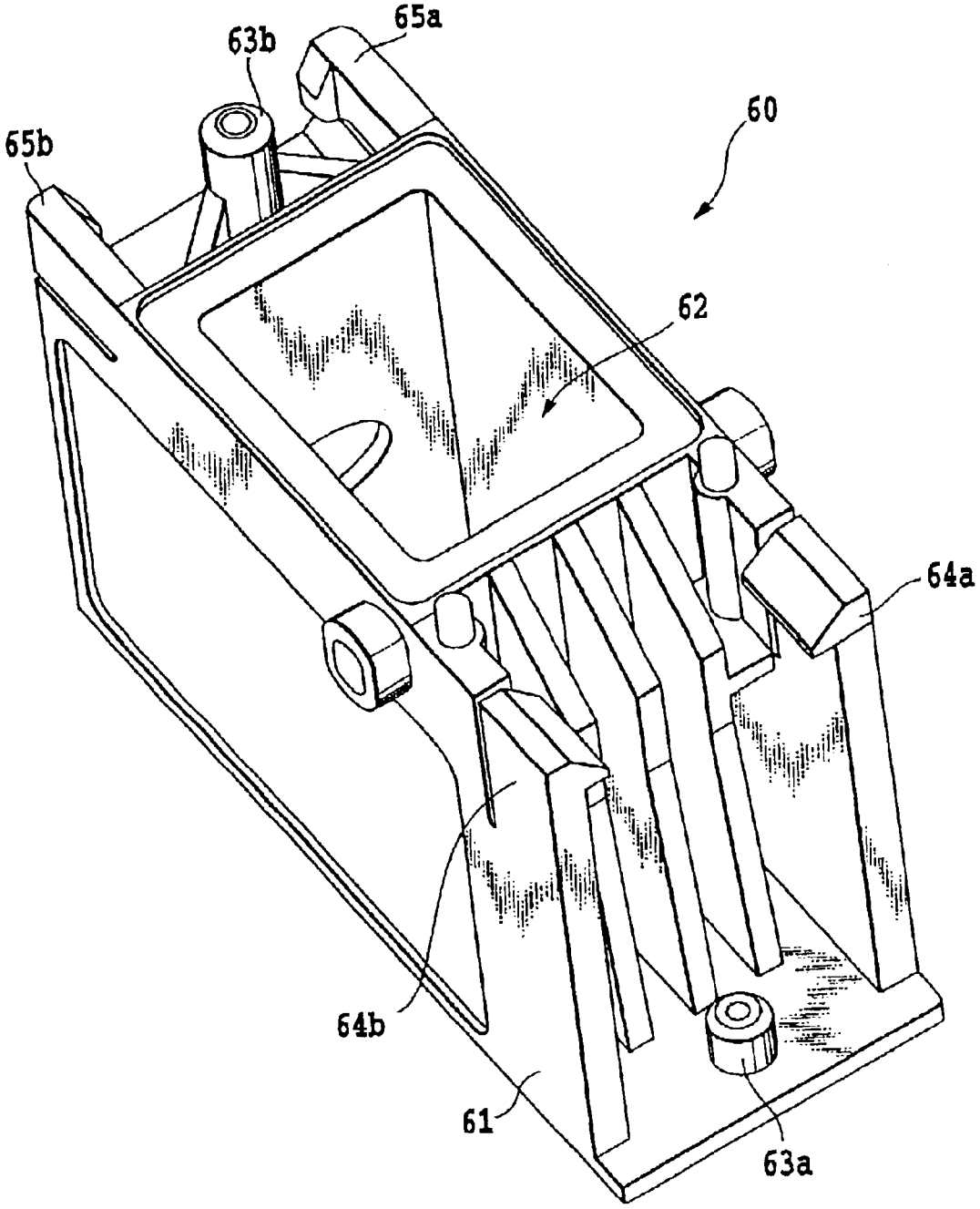
FIG. 9 is a perspective view illustrating the print liquid storage unit of the liquid jet print head of FIGS. 2 and 3.

The above described print head 50 is held by the print liquid storage unit 60. As shown in FIG. 9, the print liquid storage unit 60 has a box frame 61 having a common liquid chamber 62 that can hold a desired amount of print liquid and hold the liquid temporarily or to an end. A handle 67 is formed on the top of the box frame 61 The handle 67 is held by fingers when the print head 50 is attached to or detached from the carriage 2 of the inkjet printer 1.

The box frame 61 has bosses 63*a*, 63*b*, first snap fit portions 64*a*, 64*b*, and second snap fit portions 65*a*, 65*b* for the connection with the flow path forming member 55 of the printing unit 51. The bosses 63*a*, 63*b* are respectively inserted in holes 55*d*, 55*e* (FIG. 8) formed in the flow path forming member 55. The first snap fit portions 64*a*, 64*b* are engaged with the first receiving portions 55*f* (see FIG. 8) formed in the flow path forming member 55. The second snap fit portions 65*a*, 65*b* are engaged within the second receiving portions 55*g* (see FIG. 8). Thus, the box frame 61 (print liquid storage unit 60) is securely mated with the flow path forming member 55 (printing unit 51).

As shown in FIG. 2, two circular holes 66 are formed on the back of the box frame 61. In each circular hole 66, joint rubber 70 is fitted that serves as a print liquid supply inlet to the common liquid chamber 62. Each joint rubber 70 is tapered for easy insertion into the circular hole 66 and the outer diameter of one end is slightly larger than the inner diameter of the circular hole 66. Thus, the joint rubber 70 is fixed in the circular hole 66 when it is pushed into the hole 66.

Figure 12:
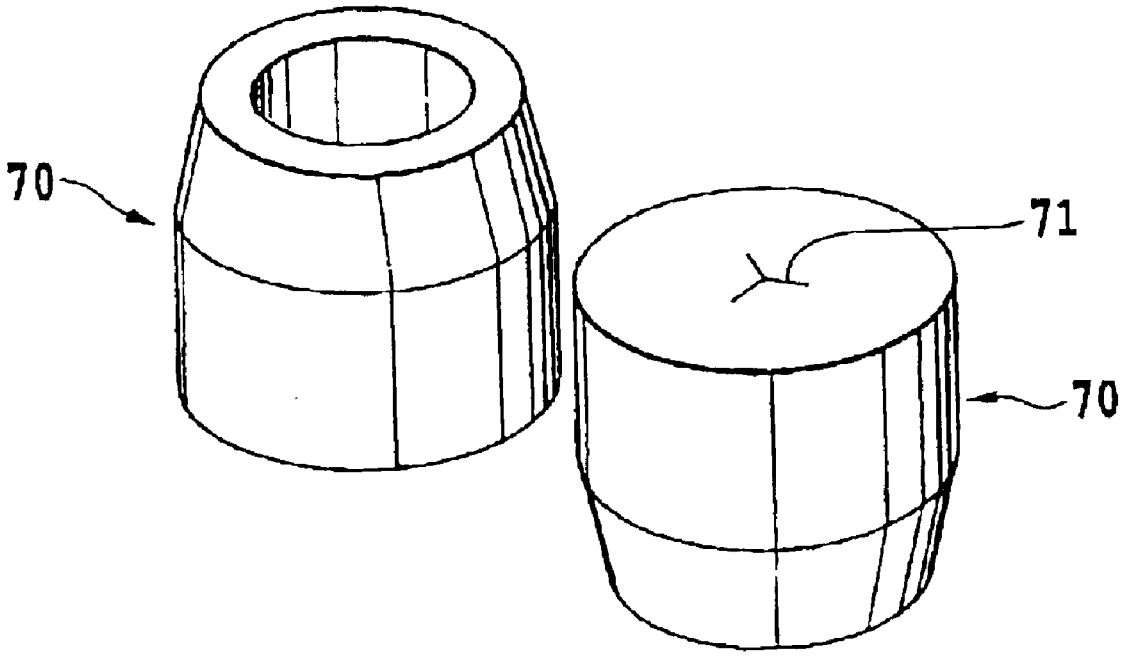
FIG. 12 is an enlarged perspective view illustrating the joint rubber disposed in the print liquid storage unit of FIG. 9.

The joint rubber 70 has a Y-shape slit 71 in the center thereof as shown FIG. 12. Into this slit 71, the print liquid supply needle (not shown) of the inkjet printer 1 is inserted to supply ink within the common liquid chamber 62. Because the slit 71 is formed to be a Y-shape, the tip of the needle is smoothly inserted into the common liquid chamber 62 of the box frame 61 through the slit 71. Moreover, since the Y-shape slit 71 receives a compressive force from the outer periphery of the joint rubber 70, the inside of the common liquid chamber 62 is kept air-tight while the needle is not inserted. On the other hand, when the needle is inserted in the slit 71, the needle receives the compressive force (grip force) from the outer periphery of the joint rubber 70 and the needle is perfectly sealed.

The circular holes 66 and joint rubber units 70 are disposed at the upper and lower portions of the back of the box frame 61 as shown in FIG. 2. The lower circular hole 66 and joint rubber 70 constitutes a supply flow path for supplying print liquid from an external print liquid storage tank (main tank, not shown) of the inkjet printer 1. That is, print liquid (ink) is supplied to inside the common liquid chamber 62 through the supply flow path. On the other hand, the upper circular hole 66 and joint rubber 70 constitutes a suction flow path for evacuating the inside of the common liquid chamber 62 by discharging air inside the chamber 62 to the outside. The pressure inside the common liquid chamber 62 is controlled by a vacuum means such as a pump to discharge air inside the chamber 62 to the outside via the suction flow path. That is, the supply of print liquid to inside the chamber 62 can be controlled by further evacuating the common liquid chamber 62 through the suction flow path.

A seal member 72 made of rubber or elastomer is disposed between the box frame 61 and the flow path forming member 55 as shown in FIG. 4. Four bosses 72*a* (see FIG. 7) are formed on the bottom side of the seal member 72. These bosses 72*a* are inserted into the holes formed on the top face of the flow path forming member 55. When the box frame 61 is mated with the flow path forming member 55, the rib 72*b* extending from the top side of the seal member 72 and the rib 72*c* extending from the bottom side of the seal member 72 are compressed and collapsed by the bottom face of the box frame 61 and the top face of the flow path forming member 55, so that the inside of the common liquid chamber 62 is sufficiently sealed. Ink within the chamber 62 of the box frame 61 is supplied to the printing unit 51 via the porous member 56, the flow path forming member 55. Then, ink is sent to each of the nozzles 525 via the supporting substrate 53 and the print liquid supply inlet 52*a* of the printing device substrate 52.

Now the connection between the flow path forming member 55 of the printing unit 51 and the print liquid storage unit 60 is explained in detail. As has been described above, the bosses 63*a*, 63*b* of the box frame 61 are respectively inserted in the holes 55*d*, 55*e* of the flow path forming member 55. Further, the first snap fit portions 64*a*, 64*b* of the box frame 61 are engaged with the first receiving portions 55*f* of the flow path forming member 55, and the second snap fit portions 65*a*, 65*b* are engaged with the second receiving portions 55*g*. Thus, the box frame 61 is securely mated with the flow path forming member 55 to constitute the print head 50. Also, the bosses 63*a*, 63*b* of the box frame 61 are inserted in the holes 55*d*, 55*e* of the flow path forming member 55 so that the box frame 61 is correctly positioned in the predetermined position of the flow path forming member 55.

As shown in FIG. 4, the elastic portions of the first snap fit portions 64*a*, 64*b* extend in the direction (Z direction, see FIG. 13) for connection between the box frame 61 and the flow path forming member 55. On the other hand, the elastic portions of the second snap fit portions 65*a*, 65*b* extend in the direction (Y direction, see FIG. 13) perpendicular to that for the connection therebetween. If a force acts on the print head 50 to separate the box frame 61 from the flow path forming member 55, the elastic portions of the first snap fit portions 64*a*, 64*b* receive tension in the longitudinal direction thereof. In this case, since the first snap fit portions 64*a*, 64*b* are rigid enough to bear the tension, the first snap fit portions 64*a*, 64*b* are not released from the first receiving portions 55*f* by the tension.

On the other hand, since the seal member 72 is compressed by the box frame 61 and the flow path forming member 55 that are connected with each other, a resilient force of the seal member 72 constantly acts on the box frame 61 and the flow path forming member 55 so as to separate them. However, the elastic portions of the first snap fit portions 64*a*, 64*b* have enough strength to bear the resilient force from the seal member 72. In addition, since the hook faces of the first snap fit portions 64*a*, 64*b* are engaged with the first receiving portions 55*f* substantially in parallel with each other, the printing unit 51 and the print liquid storage unit 60 are mated with each other securely and precisely.

If a force acts on the engagement between the second snap fit portions 65*a*, 65*b* and second receiving portions 55*g* to separate the box frame 61 from flow path forming member 55, elastic portions of the second snap fit portions 65*a*, 65*b* receive bending stress. Since the second snap fit portions 65*a*, 65*b* do not have enough strength to bear the bending force, the second snap fit portions 65*a*, 65*b* bend and deform although they are not released from the second receiving portions 55*g*. Further, a repulsive force of the seal member 72 constantly acts on the printing unit 51 and the print liquid storage unit 60. Accordingly, it the second snap fit portions

65*a*, 65*b* bend and deform due to the bending stress, the printing unit 51 and the print liquid storage unit 60 could move to separate from each other, so that the positioning accuracy of the printing unit 51 and the print liquid storage unit 60 may become imprecise.

In such a case, in response to the repulsive force of the seal member 72, tensile stress acts on the elastic portions of the first snap fit portions 64*a*, 64*b* in the longitudinal direction thereof and bending stress acts on the elastic portions of the second snap fit portions 65*a*, 65*b* in the direction perpendicular to the longitudinal direction thereof. Since the box frame 61 has a one-piece structure made of a single material, the tensile stress becomes larger than the bending stress. Accordingly, with respect to the repulsive force of the seal member 72, the first snap fit portions 64*a*, 64*b* become more resistive than the second snap fit portions 65*a*, 65*b*. Thus, the engagement portion between the first snap fit portions 64*a*, 64*b* and the first receiving portions 55*f* bears the repulsive force of the seal member 72.

In contrast, if a force acts on the first snap fit portions 64*a*, 64*b* and second snap fit portions 65*a*, 65*b* in the direction where hooks retract, the elastic portions of the first snap fit portions 64*a*, 64*b* receive bending stress and easily bend. If the first snap fit portions 64*a*, 64*b* are nearly separated from the first receiving portions 55*f*, the hook faces of the first snap fit portions 64*a*, 64*b* contact the edges of the first receiving portions 55*f* in a tilting state. In such a case, the friction in the contact between them will increase. Accordingly, the first snap fit portions 64*a*, 64*b* do not easily return to the predetermined locking position unless the elastic recovering force of the first snap fit portions 64*a*, 64*b* is large enough to resist the friction. Then, an additional force acts on the first snap fit port-ions 64*a*, 64*b* and the like, the first snap fit portions 64*a*, 64*b* gradually leave from the first receiving portions 55*f*, so that the engagement between the first snap fit portions 64*a*, 64*b* and the first receiving portions 55*f* may be released.

Also in the engagement between the second snap fit portions 65*a*, 65*b* and the second receiving portions 55*g*, the elastic portions of the second snap fit portions 65*a*, 65*b* bend and deform as well as the first snap fit portions 64*a*, 64*b* and the first receiving portions 55*f*. However, since the hook faces of the second snap fit portions 65*a*, 65*b* contact with the second receiving portions 55*g* almost in parallel with the receiving portions 55G, their contact angle does not change almost at all even if the second snap fit portions 65*a*, 65*b* bend and deform. Accordingly, the second snap fit portions 65*a*, 65*b* immediately return to the predetermined locking position because the friction on the hook faces is small.

As has been described, the box frame 61 has the first snap fit portions 64*a*, 64*b* and the second snap fit portions 65*a*, 65*b* of which elastic portions extend in different directions (perpendicular to each other). Thus, the printing unit 51 (flow path forming member 55) is precisely positioned with respect to the print liquid storage unit 60 (box frame 61).

That is, if a force acts on the print head 50 to separate the box frame 61 from the flow path forming member 55, the first snap fit portions 64*a*, 64*b* operate so as to hold their engagement. On the other hand, if a force acts on the first snap fit portions 64*a*, 64*b* and second snap fit portions 65*a*, 65*b* in the direction where hooks retract, the second snap fit portions 65*a*, 65*b* operate so as to hold their engagement. The positioning accuracy between the printing unit 51 and the print liquid storage unit 60 is maintained by, in major, the engagement between the first snap fit portions 64*a*, 64*b* and the first receiving portions 55*f*.

Moreover, if a force acts on the first snap fit portions 64*a*, 64*b* and second snap fit portions 65*a*, 65*b* in the direction where hooks retract, the engagement between the second snap fit portions 65*a*, 65*b* and the second receiving portions 55*g* is not easily released. Thus, the printing unit 51 is securely mated with the print liquid storage unit 60, and there is no fear that the first snap fit portions 64*a*, 64*b* may be unlocked off the first receiving portions 55*f*.

In order to improve the durability against the repulsion of the seal member 72 and falling shocks or the like, it may be possible to enhance rigidity in the elastic portions of the snap fit portions by making them thicker. Such a method, however, leads to a larger engagement portion between the box frame 61 and the flow path forming member 55 because the snap fit portions grow in size. In addition, if the rigidity in the snap fit portions is increased, an assembly of components may need more forces and become difficult to perform. In contrast, according to the present embodiment, without increasing the thickness of the elastic portions of snap fit portions, the box frame 61 can be securely mated with the flow path forming member 55, and the print head 50 can be made compact at low cost. Moreover, since the forces needed for mating the box frame 61 with the flow path forming member 55 are small, the productivity can be raised.

Next, a procedure for installing the print head 50 onto the carriage 2 of the inkjet printer 1 will be described with reference to FIGS. 13 and 14.

Figure 13:
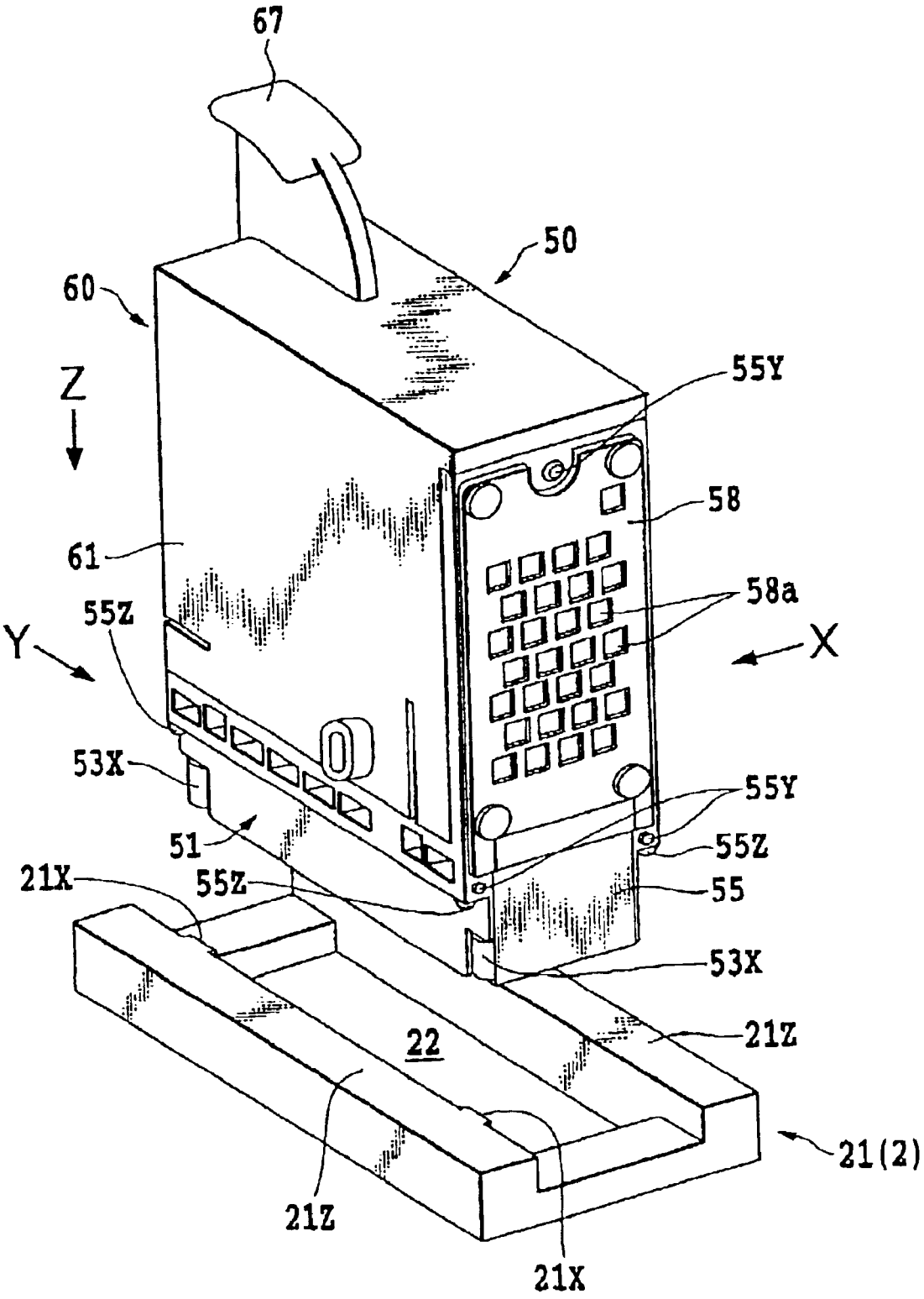
FIG. 13 is a perspective view illustrating the steps of installing the liquid jet print head of FIGS. 2 and 3 on the carriage of the liquid jet printing apparatus of FIG. 1.
Figure 14:
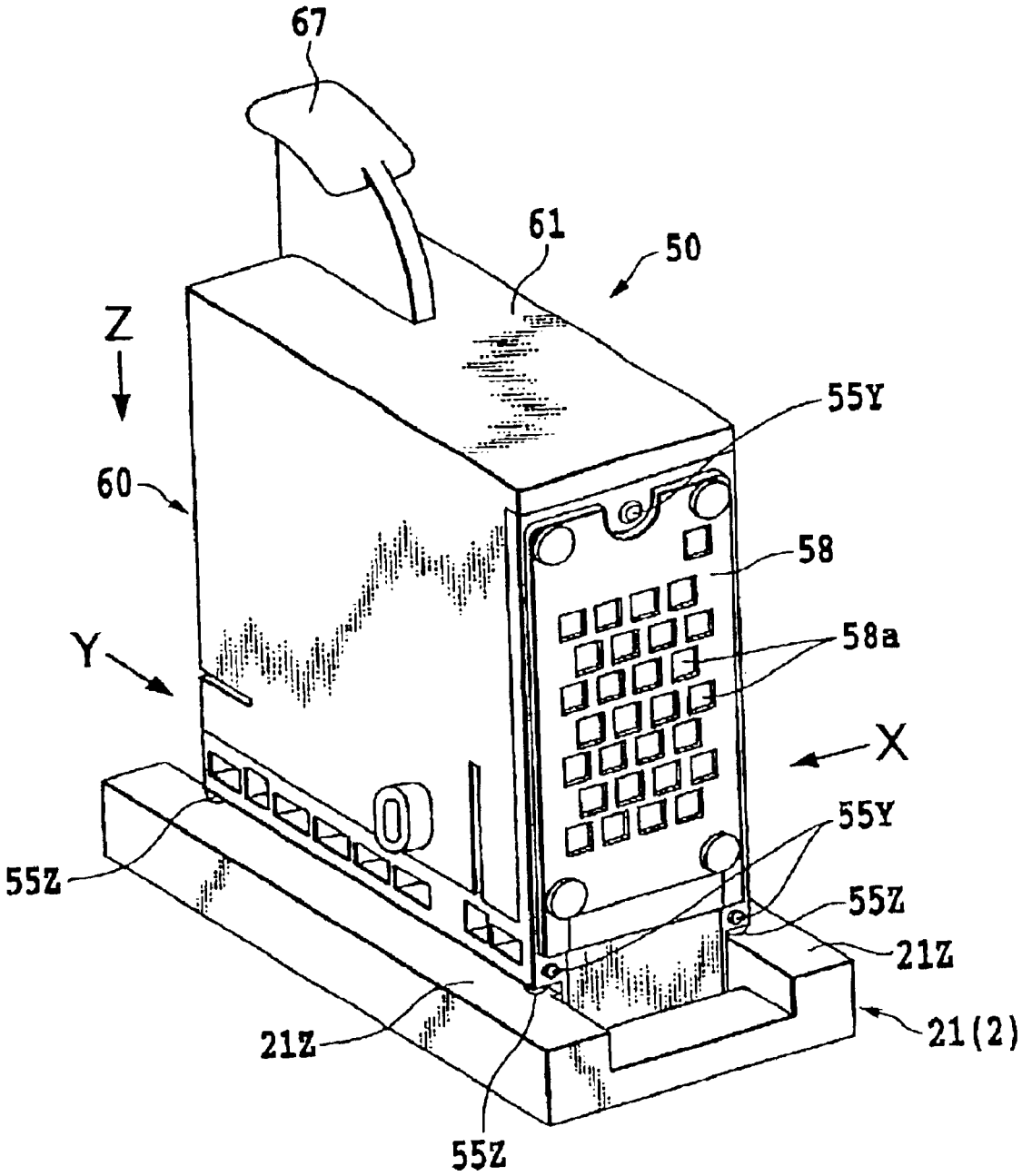
FIG. 14 is a perspective view illustrating the steps of installing the liquid jet print head of FIGS. 2 and 3 on the carriage of the liquid jet printing apparatus of FIG. 1.

At first, the carriage 2 shown in FIGS. 13 and 14 are described. These drawings show only a part (bottom portion) of the carriage 2 for simplicity. The bottom portion 21 of the carriage 2 has an opening 22 for receiving the print head 50. The inner walls of the opening 22 has two projections 21X for receiving (contacting with) the projections 53X of the supporting substrate 53 included in the printing unit 51 of the print head 50. Further, the bottom portion 21 has two receiving faces 21Z for receiving (contacting with) the semi-spherical bosses 55Z formed in the flow path forming member 55 included in the printing unit 51 of the print head 50. The receiving faces 21Z are formed in parallel to each other and on the same level. Although not shown in FIG. 13, the carriage 2 has a receiving portion that contacts with at least one of the positioning projections 55Y formed in the flow path forming member 55 of the printing unit 51.

When a user inserts the print head 50 onto the carriage 2 in the Z direction, as shown in FIG. 13, the print head 50 is pushed toward three (X, Y and Z) directions by the pushing means (not shown) included in the inkjet printer 1 for the carriage 2. In the present embodiment, the box frame 61 of the print liquid storage unit 60 receives all the pushing forces in three directions. If the print liquid capacity is increased by enlarging the print head, the pressure applied to the print head also increases when the print head is installed (inserted) onto the carriage. However, the print liquid storage unit 60 (box frame 61) receives all the pressures in three directions in this embodiment, there is no need to enlarge the printing unit 51. Accordingly, the printing unit 51 is not required to be large. As a result, the print head 50 can be manufactured at low cost and its productivity can be improved.

When the three-dimensional pressures are applied to the print liquid storage unit 60 of the print head 50, the semi-spherical bosses 55Z of the printing unit 51 contact with the corresponding receiving faces 21Z of the carriage 2, each of projections 53X contact with the corresponding projection 21X of the carriage 2, and at least one of the positioning projections 55*y* contacts with the predetermined receiving portion (not shown) of the carriage 2. As a result, the print head 50 is precisely positioned and installed onto the carriage 2 or inkjet printer 1.

That is, in the invention, the projections 53X of the supporting substrate 53 that define a reference plane used as the reference for mounting of the printing device substrate 52 are also used as the positioning reference for installing the print head 50 onto the carriage 2. Thus, after the print head 50 has been mounted onto the carriage 2, the amount of tilting of the printing device substrate 52 (nozzle array 525) is determined only by the alignment accuracy of the printing device substrate 52 determined by the reference plane (projections 53X of the supporting substrate 53) and the contact accuracy between the projections 53X and the projections 21X of the carriage 2. Accordingly, it is possible to prevent the positioning accuracy of the nozzle array 525A of the print head 50 with respect to the carriage 2 (inkjet printer 1) from deteriorating due to accumulated assembly errors. As a result the print head 50 can be installed onto the carriage 2 in the right (correct) position precisely.

In an inkjet printer 1 with the above print head 50, tilting of rules lines can be prevented and thus the quality of printed images can be significantly improved. At the same time, it becomes possible to use a long nozzle array 525A in the print head 50, and the print head 50 can be driven with a high frequency.

As has been described above, the supporting substrate 53 is made of a rigid material such as ceramics and alumina. Accordingly, deformation and wear of the supporting substrate 53 or projections 53X can be minimized. As a result, it is possible to keep the reference plane defined by the projections 53X of the supporting substrate 53 uniform. Even when the print head 50 is frequently attached to or detached from the carriage 2, the amount of tilting of the nozzle array 525A can always be precisely adjusted with high repeatability when the print head 50 is installed in the inkjet printer 1. As a result, the reliability of the inkjet printer 1 can be improved.

If the supporting substrate 53 is made of ceramics, the supporting substrate 53 can be manufactured with high dimensional and geometric accuracy. Thus, the printing device substrate 52 (and the orifice plate that will be described later) can be mounted on the supporting substrate 53 with high accuracy. If the supporting substrate 53 is made of alumina, the temperature characteristics of alumina improve the overall temperature characteristics of the print head 50 where printing devices are densely installed, so that an overheat of the print head 50 is effectively prevent. Since alumina is highly resistant to chemical agents, highly rigid and easy to machine with high dimensional accuracy, alumina satisfies the requirements for the supporting substrate 53.

Moreover, in the liquid jet print head 50, all the three positioning references 53X, 55Y and 55Z are gathered in the printing unit 51. According to the present invention, compared with the case where three positioning references are separated into the printing unit and print liquid storage unit, it becomes possible to prevent the components of the print head from being disposed off the right positions. As a result, the nozzle array 525A can be precisely installed in the inkjet printer 1 when the print head 50 is mounted on the carriage 2.

In the above described printing unit 51, the components that need high-precision machining, special material and high mechanical strength may be limited to those used in the positioning references 53X, 55Y and 55Z. Thus, the dimensional accuracy and reliability of the assembled print head 50 can be easily improved, and the cost of the print head 50 can be reduced. That is, if the printing unit 51 includes a minimum set of components that satisfy the required performance for the print head 50, the print liquid storage unit 60 may be made of inexpensive and conventional material, and the total cost of the print head 60 can be appropriately distributed to each component. Furthermore, the positioning references can be omitted from the print liquid storage unit 60, the design of the liquid storage unit 60 becomes flexible, and it becomes easy to enlarge the capacity of the print head 50.

Although the above example is an inkjet printer 1 where one print head 50 is installed onto the carriage 2, the printer of the invention is not limited to such a printer. The present invention can also be applied to in either a printer where a single print head is installed on the carriage or a printer where a plurality of print heads are installed on the carriage. All the three-dimensional positioning references used for installing the print head 50 on the carriage 2 may be formed in the flow path forming member 55. That is, if the positioning references in the three directions are gathered in a specific unit, it becomes possible to clearly distinguish components that need high precision and those that do not, and the productivity can be improved.

Figure 15:
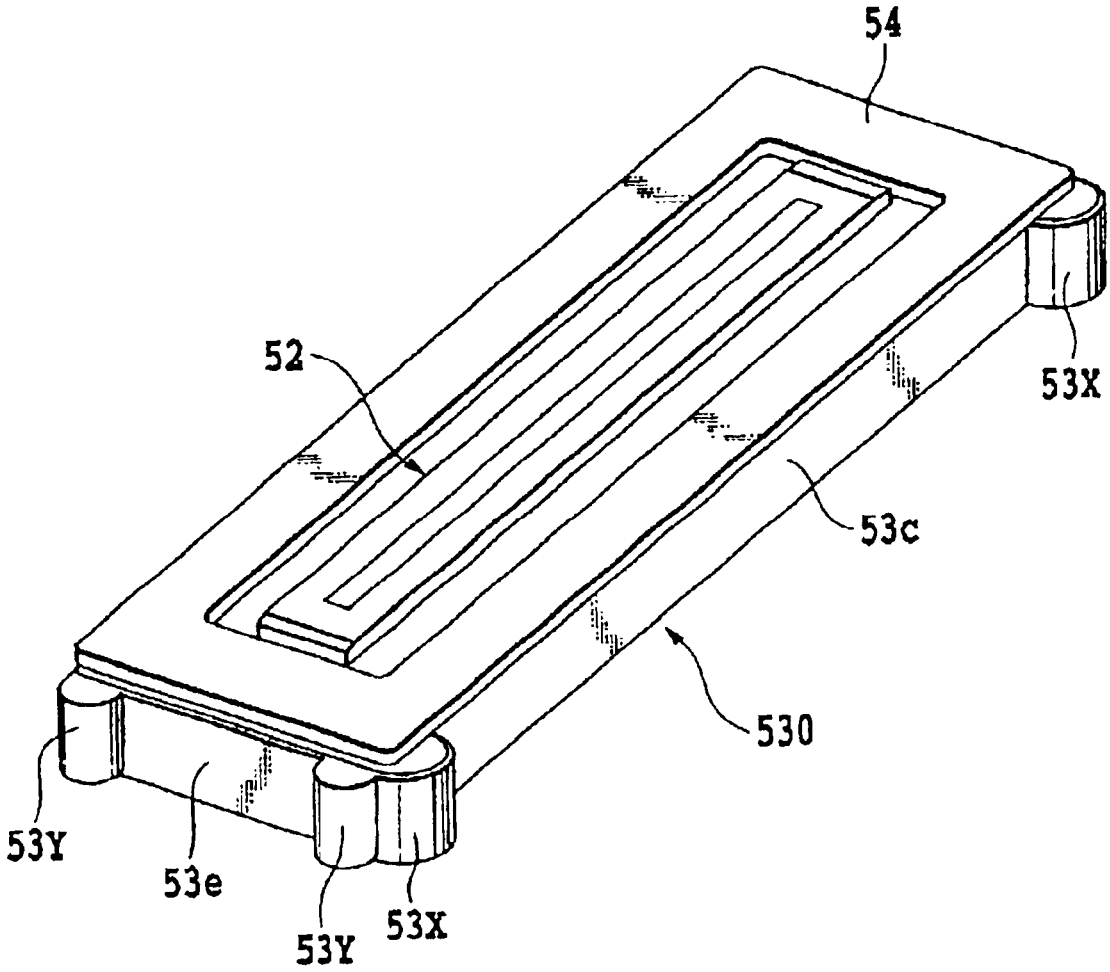
FIG. 15 is a perspective view illustrating a variation of the first embodiment of the liquid jet print head according to the invention.

Further, as shown in FIG. 15, the positioning references may be defined along two side faces of the supporting substrate 53.

The supporting substrate 530 shown in FIG. 15 further includes two projections 53Y in addition to the projections 53X. The projections 53Y are formed on the side face 53*e* perpendicular to the side face 53*c*. Since the projections 53Y can also define a reference plane, this reference plane may be used for positioning the printing device substrate 52. These projections 53Y, instead of the above projections 55Y, may be used as a positioning reference (second positioning reference in the Y direction) for the print head 50 with respect to the carriage 2. By this configuration, the print head 50 can be installed in the right position of the carriage 2, with the nozzle array being precisely aligned as intended. Further, it is also possible to gather all the three-dimensional positioning references in the supporting substrate 53.

Figure 16:
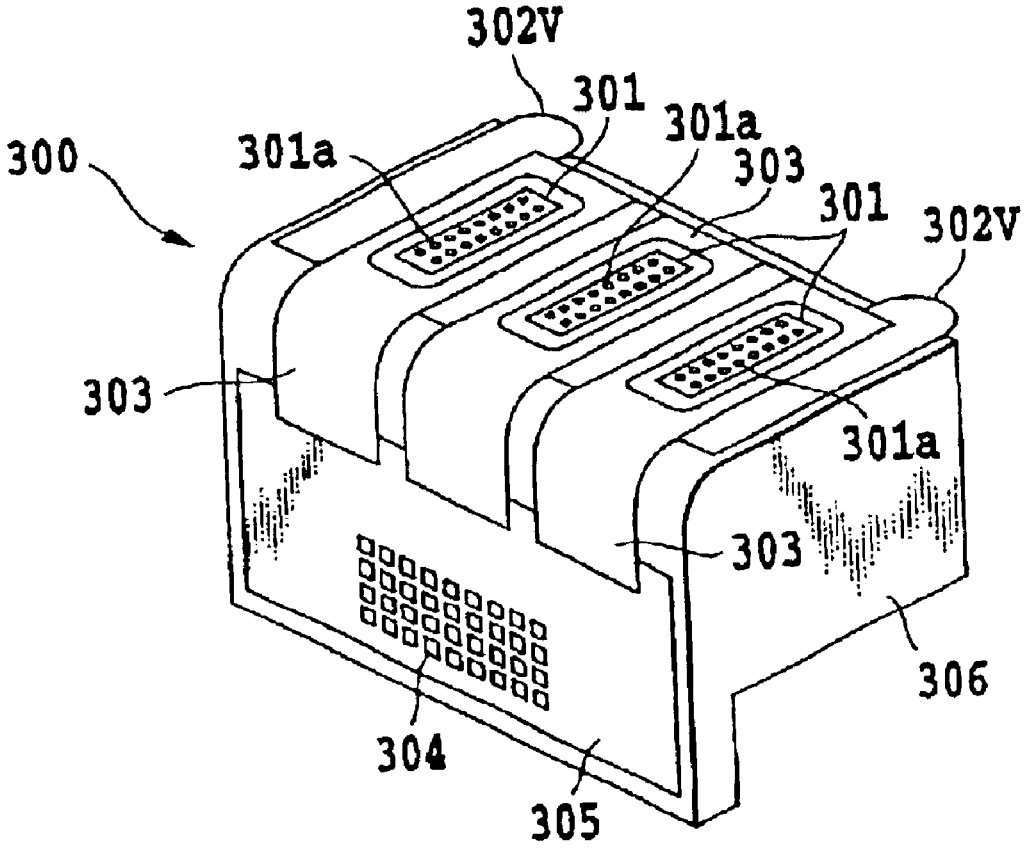
FIG. 16 is a perspective view illustrating a second embodiment of the liquid jet print head according to the invention.
Figure 17:
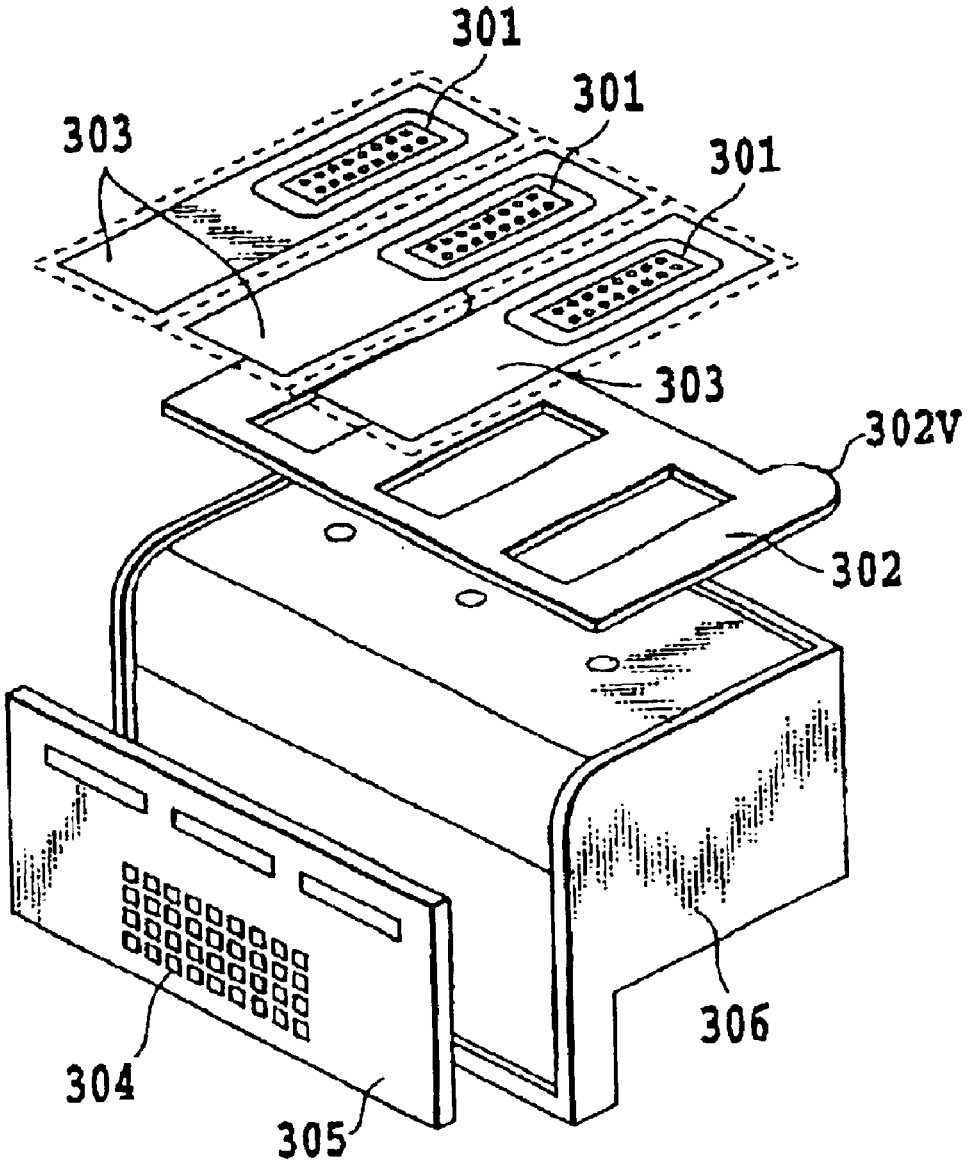
FIG. 17 is a perspective view illustrating a second embodiment of the liquid jet print head according to the invention.

FIGS. 16 and 17 illustrates a second embodiment of a liquid jet print head according to the invention.

The print head 300 shown in these drawings can be installed in, for example, a full-color inkjet printing apparatus. The print head 300 has a plurality (three in this embodiment) of printing device substrates 301 with a plurality of nozzles 301*a* that are arranged in correspondence with the electrothermal converting elements. Each printing device substrate 301 is fixed on a supporting substrate 302 made of rigid material.

Wiring sheets 303 such as TAB and FPC are bonded to the supporting substrate 302 in correspondence with the each of printing device substrates 301. Each printing device substrate 301 is electrically connected with each wiring sheet 303. Each wiring sheet 303 is connected to a contact substrate 305 such as PWB, TAB and FPC having a plurality of contact pads 304. The printing device substrate 301 and contact substrate 305 are mated with a flow path forming member 306.

The supporting substrate 302 of this embodiment includes two projections 302V each having semi-spherical cross section. These projections 302V are formed on a side face parallel to the direction in which the printing device substrates 301 are arranged. As well as the first embodiment, the projections 302V define a reference plane for mounting the printing device substrates 301 on the supporting substrate 302. The projections 302V are also used as a positioning reference for installing the print head 300 onto the printing apparatus (carriage).

In such a print head 300 where a plurality of printing device substrates 301 are installed, the array of printing device substrates 301 becomes longer than the nozzle array in the supporting substrate 302. Thus, by positioning the array of printing device substrates 301 in parallel to the reference plane using the supporting substrate 302, the amount of tilting of each printing device substrate 301 can be easily controlled, and the alignment accuracy can be improved. In this embodiment, the supporting substrate 302 is shared by a plurality of the printing device substrates 301, however, the supporting substrate may be separated for each of the printing device substrates 301.

Figure 18:
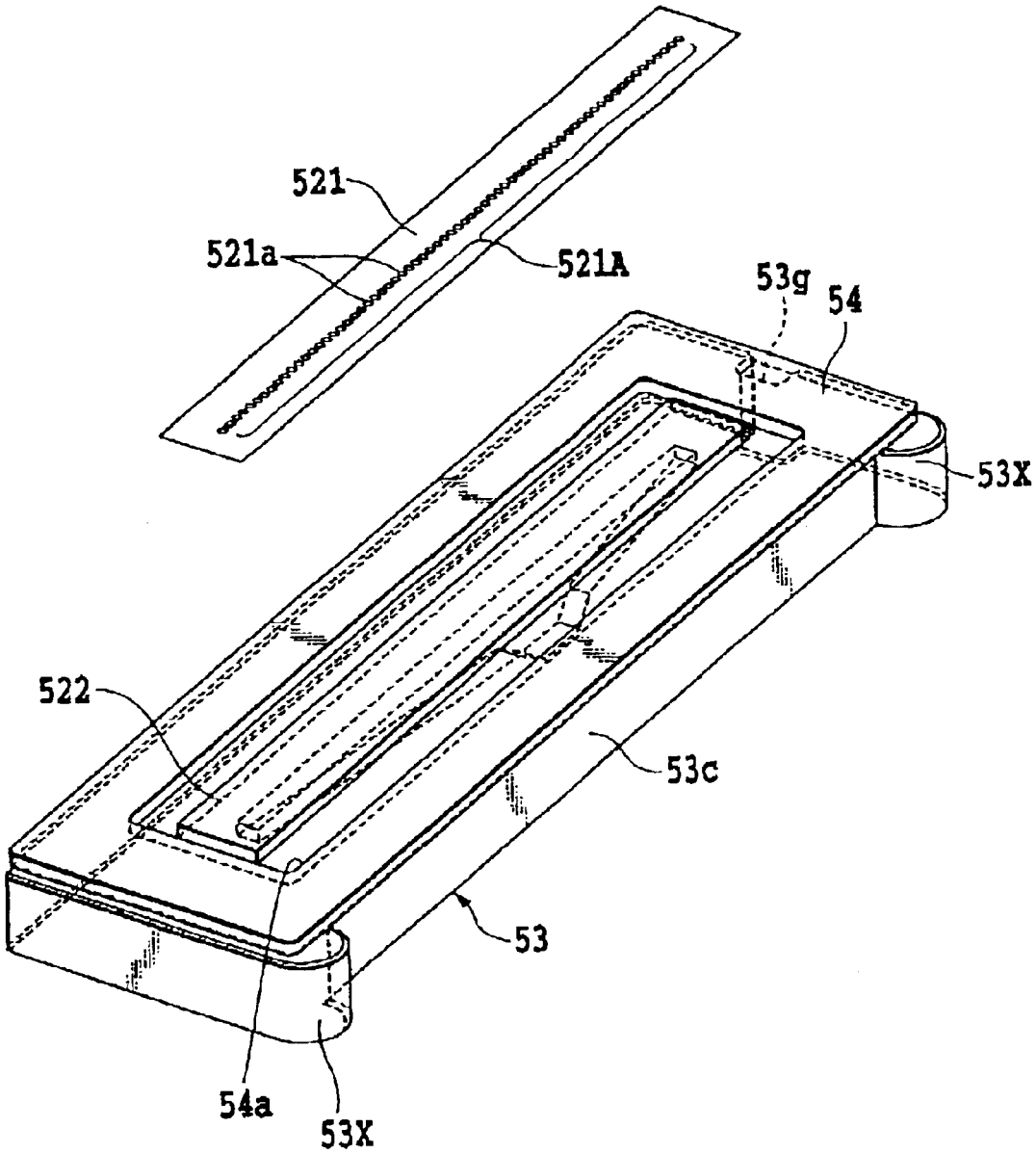
FIG. 18 is an enlarged perspective view illustrating a third embodiment of the liquid jet print head according to the invention.
Figure 19:
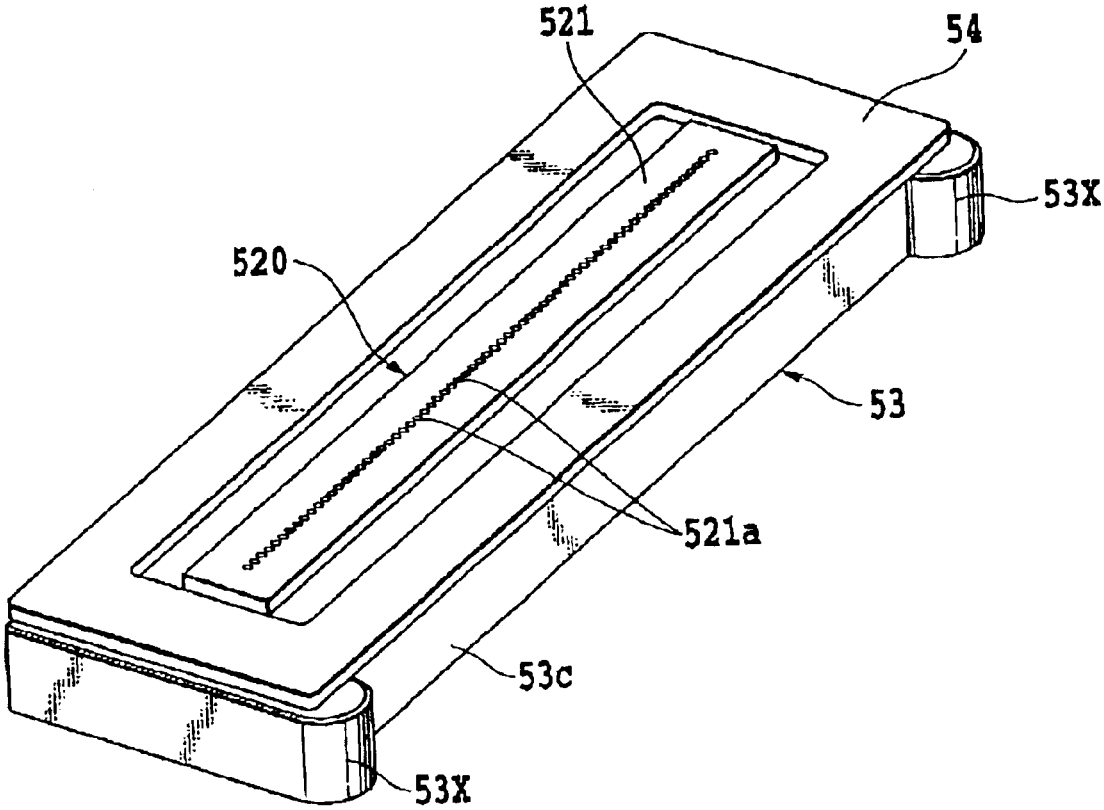
FIG. 19 is an enlarged perspective view illustrating a third embodiment of the liquid jet print head according to the invention.
Figure 20:
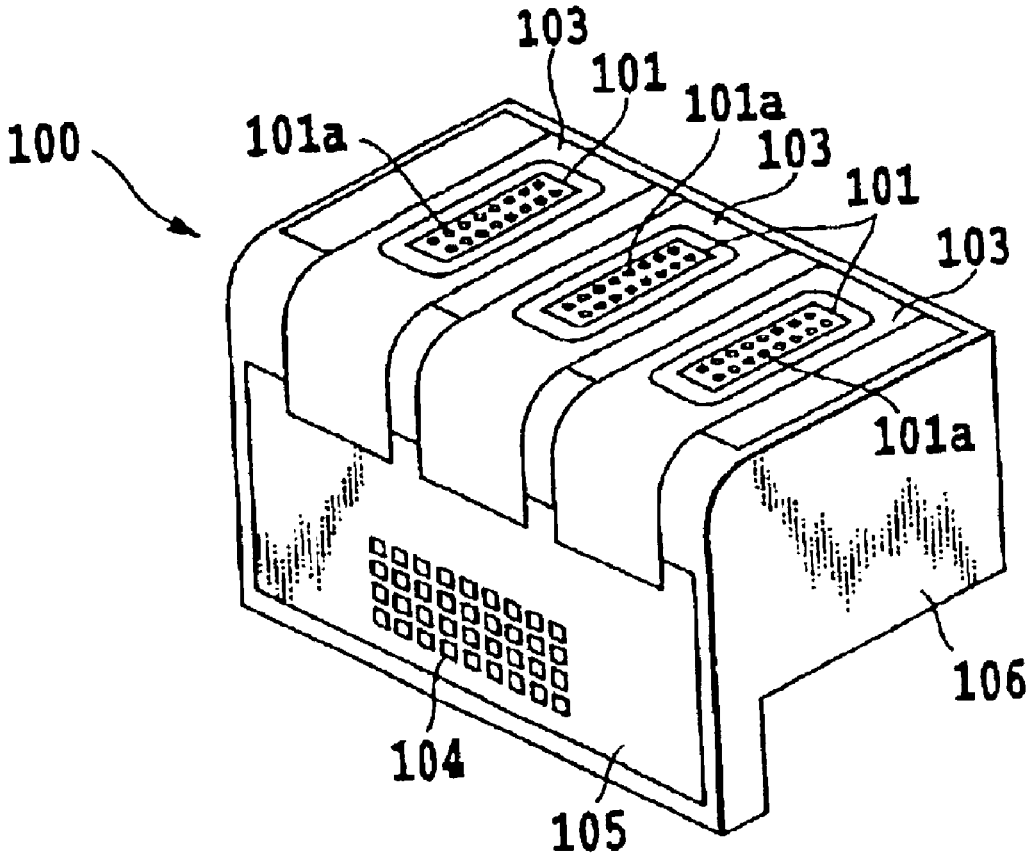
FIG. 20 is a perspective view illustrating an example of the conventional liquid jet print head.
Figure 21:
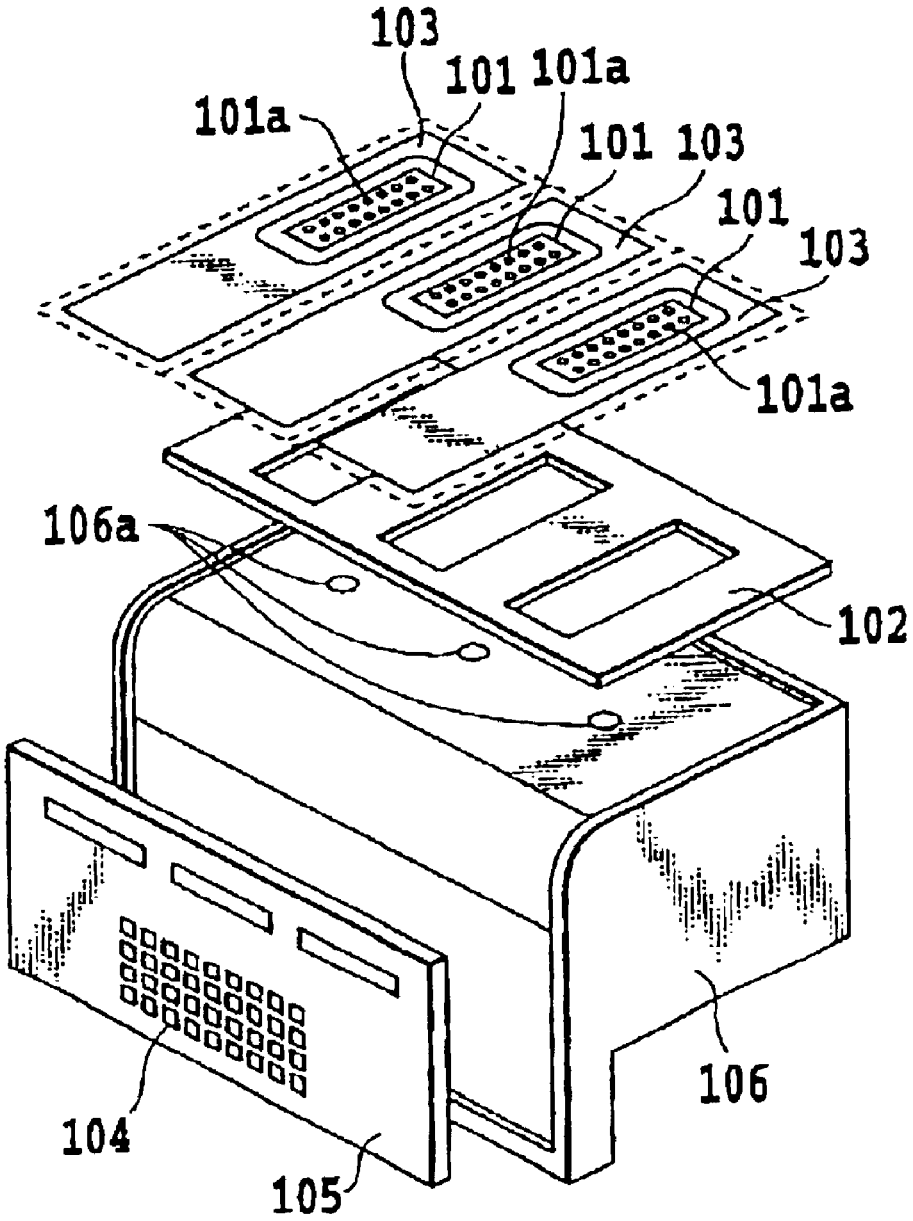
FIG. 21 is a perspective view illustrating an example of the conventional liquid jet print head.
Figure 22:
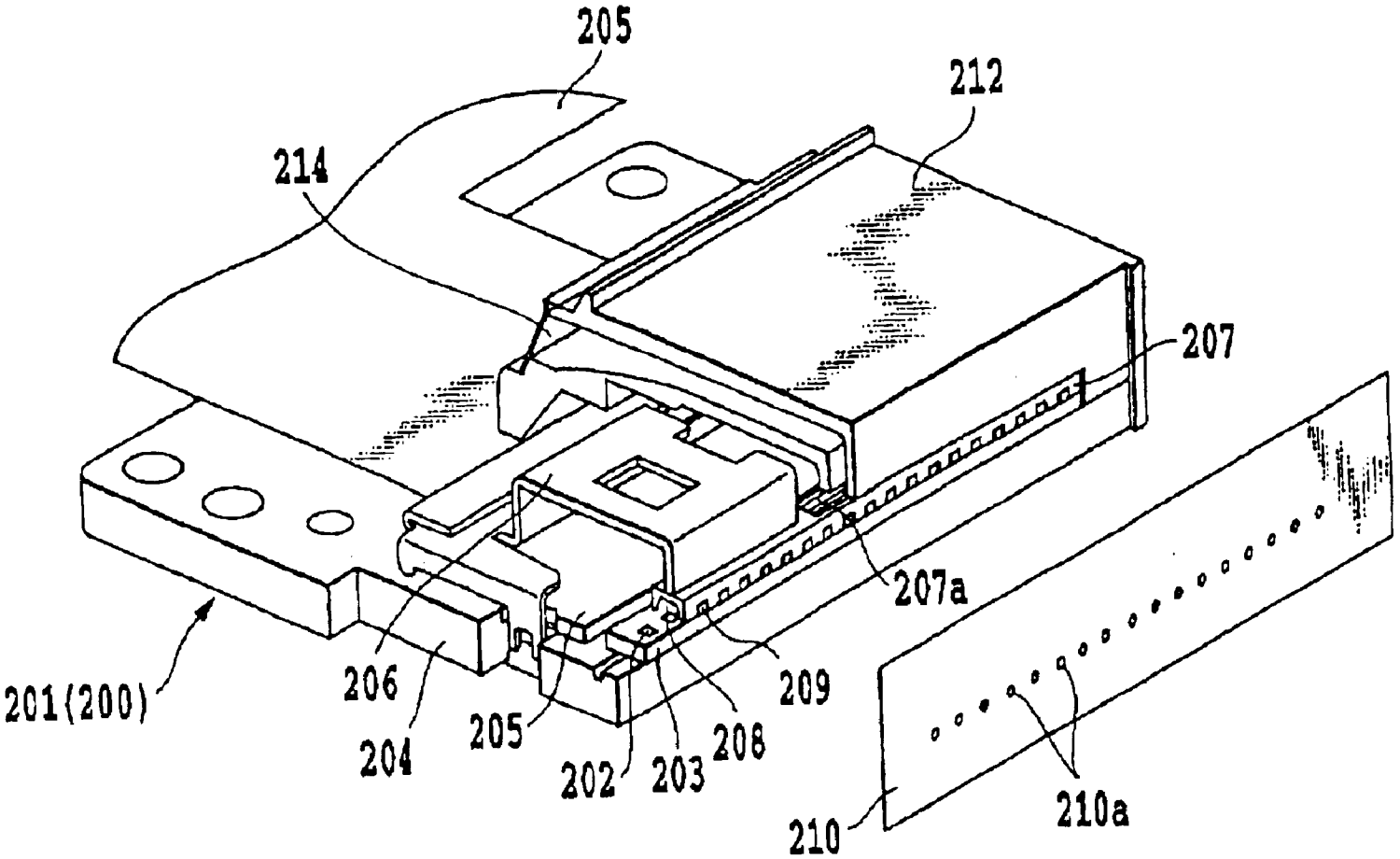
FIG. 22 is a perspective view illustrating another example of the conventional liquid jet print head.
Figure 23:
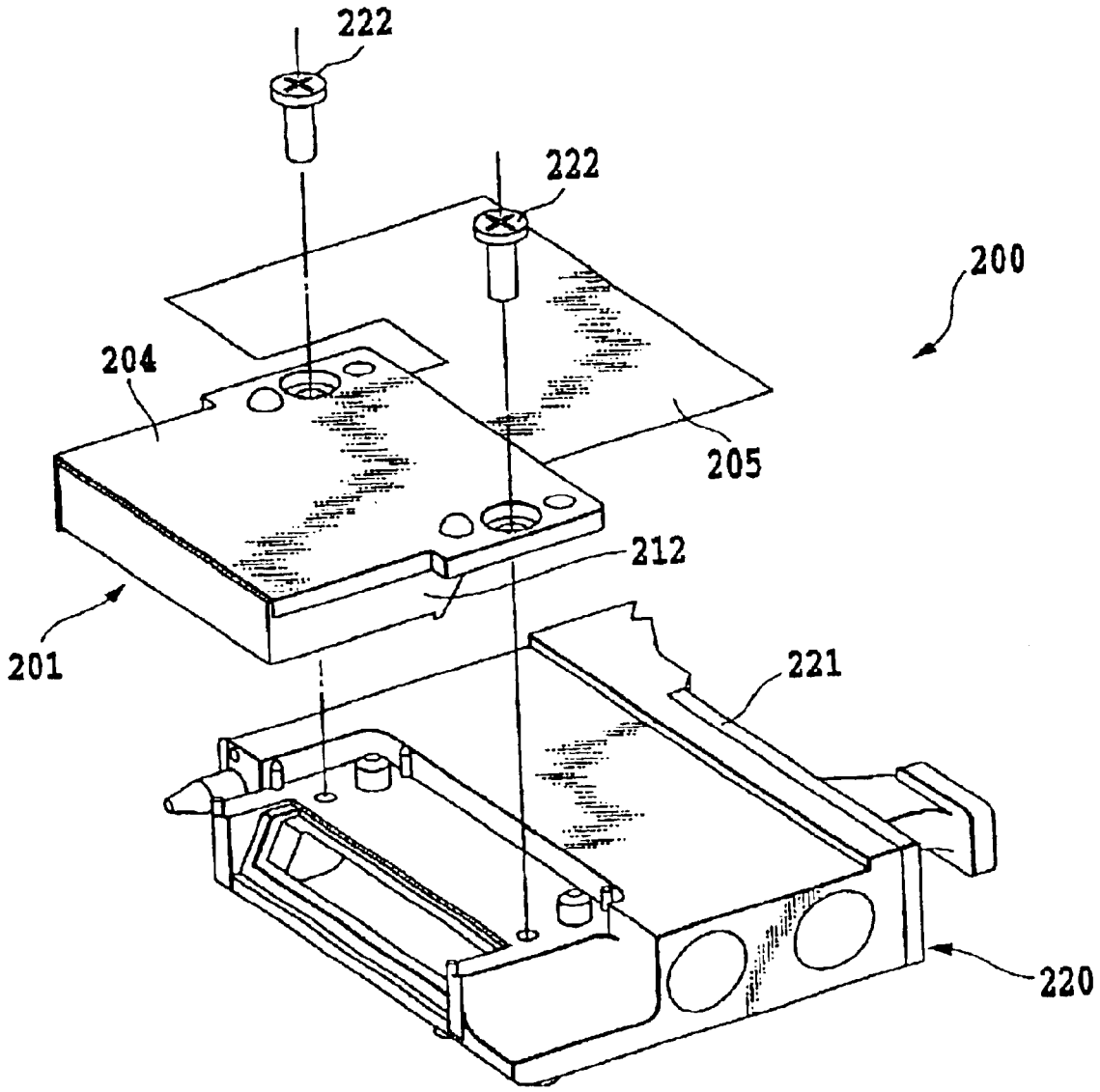
FIG. 23 is a perspective view illustrating another example of the conventional liquid jet print head.

FIGS. 18 and 19 show a third embodiment of a liquid jet print head according to the invention.

The printing device array 520 shown in FIGS. 18 and 19 has an orifice plate 521 where a plurality of nozzles 521*a* are arranged and a substrate 522 having a plurality of printing devices arranged in correspondence with a plurality of nozzles 521*a* of the orifice plate 521. The substrate 522 is fixed to the supporting substrate 53. In the liquid jet print head 50 with the printing device array 520, ink (print liquid) forms a meniscus in the nozzle 521*a* and fills the print liquid flow path near the printing device. Under this state, print liquid on the printing device is quickly heated so as to produce bubbles by film boiling. The pressure of growing bubbles ejects ink drops from the nozzle 521*a*.

In this embodiment, the reference plane defined by the supporting substrate 53 is used to adjust the amount of tilting of the nozzle array 521A of the orifice plate 521 with respect to the supporting substrate 53, or the direction of ejecting ink drops, when the orifice plate 521 is fixed in a predetermined position of the substrate 522 on the supporting substrate 53. The orifice plate 521 is fixed on the supporting substrate 53 using the reference plane defined by two projections 53X, so that the amount of tilting of the orifice plate 521 with respect to the supporting substrate 53 controlled precisely and the amount of tilting of the nozzle array 521A can be set in the print head 50 at a precise value. In this case, if the distance between the two projections 53X in the supporting substrate 53 is longer than the nozzle array 521A of the orifice plate 521, the amount of tilting of the orifice plate 521 with respect to the reference plane can be easily adjusted during alignment.

Moreover, the print head 50 is installed in the liquid jet printing apparatus (carriage) using the reference plane again, so that the amount of tilting of the nozzle array 521A with respect to the printing apparatus can be precisely set. With this configuration, positioning errors of the nozzle array 521A can be significantly reduced in the printing apparatus when the liquid jet print head 50 is finally installed therein, and the positioning accuracy of nozzle array 521A can be maintained high.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A liquid jet print head capable of being installed in a liquid jet printing apparatus, comprising:

a printing unit comprising (i) a printing device array having a plurality of nozzles for ejecting print liquid and a plurality of printing devices, and (ii) a supporting member, to which said printing device array is attached, having a print liquid flow path for supplying print liquid to said printing device array, said printing unit being adapted to be capable of sending electric signals for printing to said printing device array; and a print liquid storage unit connectable to said printing unit, said print liquid storage unit storing print liquid for said printing unit, wherein said supporting member is formed to define a reference plane for determining the amount of tilting of an array of said nozzles with respect to said supporting member when said printing device array is aligned and fixed at a predetermined position of said supporting member, and wherein said reference plane can be used as a reference for positioning when said print head is installed in said liquid jet printing apparatus.

2. The liquid jet print head as claimed in claim 1, wherein said printing device array is a printing device substrate having said array of said nozzles for ejecting print liquid and an array of said printing devices.

3. The liquid jet print head as claimed in claim 1, wherein said printing device array comprises (i) an orifice plate having said array of said nozzles, and (ii) a substrate having said plurality of printing devices arranged in correspondence to said nozzles of said orifice plate, said substrate being attached to said supporting member, and wherein said reference plane defined by said supporting member can determine the amount of tilting of said array of nozzles of said orifice plate with respect to said supporting member when said orifice plate is aligned and fixed at a predetermined position of said substrate attached to said supporting member.

4. The liquid jet print head as claimed in claim 1, wherein said supporting member is a supporting substrate attached to a main body of said printing unit.

5. The liquid jet print head as claimed in claim 4, wherein said reference plane is defined along one side face of said supporting substrate and extends substantially in parallel with said array of nozzles.

6. The liquid jet print head as claimed in claim 4, wherein the length of said reference plane in the longitudinal direction is longer than the length of said array of nozzles.

7. The liquid jet print head as claimed in claim 4, including two reference planes, one reference plane defined along a first side face of said supporting substrate and the other reference plane defined along a second side face of said supporting substrate substantially perpendicular to said first side face.

8. The liquid jet print head as claimed in claim 4, wherein said supporting substrate is made of rigid material.

9. The liquid jet print head as claimed in claim 4, wherein said supporting substrate is made of a ceramic material.

10. The liquid jet print head as claimed in claim 4, wherein said supporting substrate is made of alumina.

11. The liquid jet print head as claimed in claim 1, wherein said printing unit further comprises a second-direction reference portion and a third-direction reference portion, said second-direction reference portion used as a reference for positioning in a second direction substantially perpendicular to a first direction in which said reference plane extends when said print head is installed in said liquid jet printing apparatus, and said third-direction reference portion used as a reference for positioning in a third direction substantially perpendicular to the first and second directions when said print head is installed in said liquid jet printing apparatus.

12. The liquid jet print head as claimed in claim 1, wherein each of said printing devices includes an electrothermal converting element and ejects print liquid drops using thermal energy generated by said electrothermal converting element.

13. A liquid jet print head capable of being installed in a liquid jet printing apparatus, comprising:

a printing unit comprising (i) a printing device array having a plurality of nozzles for ejecting print liquid and a plurality of printing devices, and (ii) a supporting member, to which said printing device array is attached, having a print liquid flow path for supplying print liquid to said printing device array, said printing unit being adapted to be capable of sending electric signals for printing to said printing device array; and a print liquid storage unit connectable to said printing unit, said print liquid storage unit storing print liquid for said printing unit, wherein said printing unit includes a first-direction reference portion, a second-direction reference portion and a third-direction reference portion which can be used as three-dimensional positioning references when said print head is installed in said liquid jet printing apparatus, and wherein a reference for positioning to align and fix said printing device array at a predetermined position of said supporting member is used as at least one of said first-direction reference portion, said second-direction reference portion and said third-direction reference portion.

14. The liquid jet print head as claimed in claim 13, wherein said printing unit includes a supporting substrate fixed thereto as said supporting member, and wherein a reference for positioning to align and fix said printing device array at a predetermined position of said supporting substrate is used as one of said first-direction reference portion, said second-direction reference portion and said third-direction reference portion.

15. The liquid jet print head as claimed in claim 13, wherein a pressing force for contacting said first-direction reference portion, said second-direction reference portion and said third-direction reference portion to predetermined positions is received by said print liquid storage unit.

16. The liquid jet print head as claimed in claim 13, wherein each of said printing devices includes an electrothermal converting element and ejects print liquid drops using thermal energy generated by said electrothermal converting element.

17. A liquid jet printing apparatus comprising:

a liquid jet print head capable of ejecting print liquid; and a carriage supporting said liquid jet print head and capable of being scanned in a main scanning direction, said carriage being scanned to form an image on a print medium by ejecting print liquid from said print head, wherein said liquid jet print head comprises:

a printing unit comprising (i) a printing device array having a plurality of nozzles for ejecting print liquid and a plurality of printing devices, and (ii) a supporting member, to which said printing device array is attached, having a print liquid flow path for supplying print liquid to said printing device array, said printing unit being adapted to be capable of sending electric signals for printing to said printing device array; and a print liquid storage unit connectable to said printing unit, said print liquid storage unit storing print liquid for said printing unit, wherein said supporting member is formed to define a reference plane for determining the amount of tilting of an array of said nozzles with respect to said supporting member when said printing device array is aligned and fixed at a predetermined position of said supporting member, and wherein said reference plane can be used as a reference for positioning when said print head is installed in said liquid jet printing apparatus.

18. A liquid jet printing apparatus comprising:

a liquid jet print head capable of ejecting print liquid; and a carriage supporting said liquid jet print head and capable of being scanned in a main scanning direction, said carriage being scanned to form an image on a print medium by ejecting print liquid from said print head, wherein said liquid jet print head comprises:

a printing unit comprising (i) a printing device array having a plurality of nozzles for ejecting print liquid and a plurality of printing devices, and (ii) a supporting member, to which said printing device array is attached, having a print liquid flow path for supplying print liquid to said printing device array, said printing unit being adapted to be capable of sending electric signals for printing to said printing device array; and a print liquid storage unit connectable to said printing unit, said print liquid storage unit storing print liquid for said printing unit, wherein said printing unit includes a first-direction reference portion, a second-direction reference portion and a third-direction reference portion which can be used as three-dimensional positioning references when said print head is installed in said carriage, and wherein a reference for positioning to align and fix said printing device array at a predetermined position of said supporting member is used as at least one of said first-direction reference portion, said second-direction reference portion and said third-direction reference portion.

* * * * *